US007195238B2

(12) United States Patent
Suga et al.

(10) Patent No.: US 7,195,238 B2
(45) Date of Patent: Mar. 27, 2007

(54) SHEET CONVEYING APPARATUS AND IMAGE FORMING APPARATUS

(75) Inventors: Takeshi Suga, Ibaraki (JP); Hiroshige Inoue, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 61 days.

(21) Appl. No.: 10/889,118

(22) Filed: Jul. 13, 2004

(65) Prior Publication Data

US 2005/0035536 A1 Feb. 17, 2005

(30) Foreign Application Priority Data

Jul. 23, 2003 (JP) ..... 2003-200735

(51) Int. Cl.
*B65H 7/06* (2006.01)

(52) U.S. Cl. ..... 271/228; 271/227; 271/249

(58) Field of Classification Search ..... 271/226–228, 271/234, 249

See application file for complete search history.

(56) References Cited

U.S. PATENT DOCUMENTS

| | | | | | |
|---|---|---|---|---|---|
| 4,823,159 | A | * | 4/1989 | Yamamoto et al. | 399/394 |
| 4,877,234 | A | * | 10/1989 | Mandel | 271/225 |
| 5,055,756 | A | | 10/1991 | Ohkoda et al. | 318/618 |
| 5,322,012 | A | * | 6/1994 | Gartner et al. | 101/232 |
| 5,358,230 | A | | 10/1994 | Ikemori et al. | 271/114 |
| 5,485,991 | A | | 1/1996 | Hirano et al. | 271/121 |
| 5,678,127 | A | | 10/1997 | Suga | 399/45 |
| 5,681,036 | A | * | 10/1997 | Wakahara et al. | 271/10.12 |
| 5,697,609 | A | * | 12/1997 | Williams et al. | 271/228 |
| 5,793,399 | A | | 8/1998 | Kawakami et al. | 347/104 |
| 5,867,196 | A | | 2/1999 | Kiyohara et al. | 347/104 |
| 5,886,729 | A | | 3/1999 | Hiramatus et al. | 347/264 |
| 5,899,451 | A | | 5/1999 | Kiyohara et al. | 271/167 |
| 5,918,876 | A | * | 7/1999 | Maruyama et al. | 271/228 |
| 5,992,993 | A | | 11/1999 | Kiyohara et al. | 347/104 |
| 6,019,365 | A | * | 2/2000 | Matsumura | 271/227 |
| 6,045,220 | A | | 4/2000 | Kiyohara et al. | 347/104 |
| 6,059,285 | A | * | 5/2000 | Suga et al. | 271/228 |
| 6,095,515 | A | | 8/2000 | Kiyohara et al. | 271/161 |
| 6,131,899 | A | | 10/2000 | Nojima et al. | 271/121 |
| 6,200,043 | B1 | | 3/2001 | Inoue et al. | 400/88 |
| 6,250,827 | B1 | | 6/2001 | Nojima et al. | 400/691 |
| 6,260,840 | B1 | | 7/2001 | Suga et al. | 271/10.12 |

(Continued)

FOREIGN PATENT DOCUMENTS

| | | |
|---|---|---|
| JP | 10-67448 | 3/1998 |

*Primary Examiner*—Patrick Mackey
*Assistant Examiner*—Jeremy R Severson
(74) *Attorney, Agent, or Firm*—Fitzpatrick, Cella, Harper & Scinto

(57) ABSTRACT

A sheet conveying apparatus for conveying a sheet using a sheet conveying unit arranged along a sheet conveying path has a skew detecting unit for detecting skew of the sheet conveyed along the sheet conveying path with respect to a sheet conveying direction, a skew correcting unit that moves in a direction for correcting the skew of the skewed sheet with the sheet nipped therein on the basis of a detection signal from the skew detecting unit, and a guide unit for supporting the skew correcting unit and guiding the sheet to the skew correcting unit, in which, when the skew correcting unit moves for correcting the skew of the sheet, the guide unit is moved together with the skew correcting unit to prevent a load from being applied to a trailing edge of the sheet.

4 Claims, 20 Drawing Sheets

U.S. PATENT DOCUMENTS 6,581,929 B2 * 6/2003 Hiramitsu ..... 271/228
6,588,746 B2 * 7/2003 Dobrindt et al. ..... 271/285
6,634,521 B1 * 10/2003 Hwang ..... 221/228
6,654,133 B2 11/2003 Inoue et al. ..... 358/1.12
6,663,103 B2 * 12/2003 Dobberstein et al. ..... 271/227
6,779,791 B2 * 8/2004 Kawamura et al. ..... 271/228
6,862,081 B2 * 3/2005 Soya ..... 355/407
6,910,689 B2 * 6/2005 Carolan ..... 271/228
2005/0012263 A1 * 1/2005 Koyanagi et al. ..... 271/227
2005/0030600 A1 * 2/2005 Takagi et al. ..... 358/498
2005/0035528 A1 * 2/2005 Suga et al. ..... 271/10.12

* cited by examiner $\theta = \tan^{-1}(\Delta t \times V_1/L)$

SHEET CONVEYING APPARATUS AND IMAGE FORMING APPARATUS

This application claims priority from Japanese Patent Application No. 2003-200735 filed on Jul. 23, 2003, which is hereby incorporated by reference.

BACKGROUND OF THE INVENTION

1. Field of the Invention

The present invention relates to a sheet conveying apparatus that has a structure for correcting skew of a sheet such as recording paper or an original to be conveyed to an image forming portion.

2. Related Background Art

Conventionally, image forming apparatuses or image reading apparatuses such as a copying machine, a printer, a facsimile machine, and a scanner include a sheet conveying apparatus that conveys a sheet such as recording paper or an original to an image forming portion or an image reading portion. The sheet conveying apparatus may be provided with correcting means for performing skew conveying correction for a sheet or positional deviation correction for a sheet in order to adjust a posture and a position of the sheet before conveying the sheet to the image forming portion or the image reading portion.

Here, as a correction process with such correcting means, a registration roller pair may be used. For example, in the case of an image forming apparatus, a so-called loop registration process is mainly used. With the loop registration process, a leading edge of a sheet is brought into abutment against a nip of a registration roller pair at rest to bend the sheet, the leading edge of the sheet is aligned with the roller nip by elasticity of the sheet to correct skew, and thereafter the registration roller pair is rotated at a predetermined timing to synchronize the sheet and an image.

However, in such a loop registration process, a loop space for forming a loop is always required, which results in an increase in a size of the apparatus. In addition, when a sufficient loop space cannot be secured, there are problems in that jam (paper jam) due to buckling occurs, in particular, in a sheet such as thin paper with low rigidity and sound (so-called loop sound) is generated when the sheet is brought into abutment against the registration roller pair.

Moreover, there is another problem in that skew conveying correction ability changes depending upon rigidity of a sheet. More specifically, in the case of the sheet such as thin paper with low rigidity, an abutting pressure at the time when the leading edge of the sheet is brought into abutment against the registration roller nip may be insufficient, which results in insufficient abutment of the leading edge of the sheet against the registration roller pair. In such a case, skew conveying correction cannot be performed completely.

In addition, in the case of a sheet such as thick paper with high rigidity, there is a deficiency in that the sheet thrusts through the nip of the registration roller pair due to an impact of abutment of the sheet against the nip of the registration roller pair. If a load or the like is applied to the registration roller pair by, for example, a brake member in order to overcome this deficiency, which results in an increase in product cost.

Further, for example, in the case in which the leading edge of the sheet is curled or bent, the leading edge of the sheet cannot be aligned with the nip portion of the registration roller pair accurately. As a result, skew conveying correction cannot be performed accurately, and printing accuracy falls.

On the other hand, in recent years, according to digitization of image forming apparatuses and image reading apparatuses, after an original is read once, image information of the original can be coded electrically and stored in a memory.

At the time of image formation, the image information in the memory is read out, and an image corresponding to the image information of the original is formed on a photosensitive member by an exposing apparatus using a laser beam, an LED array, or the like. Thus, a mechanical motion of an optical apparatus or the like is unnecessary even in copying the image on plural sheets.

Consequently, a paper interval, which is an interval between sheets, can be reduced, and a large number of sheets can be treated in a short time. As a result, for example, in the case of an image forming apparatus, at the time of image formation, improvement of an actual image formation speed can be realized without increasing a process speed.

However, if a sheet conveying apparatus adopting the above-mentioned loop registration process is used as a sheet conveying apparatus for the image forming apparatus, a sheet is stopped temporarily to form a loop. Thus, the paper interval is inevitably determined, which significantly affects the improvement of the image formation speed (productivity).

Therefore, in order to overcome such a deficiency, Japanese Patent Application Laid-Open No. H10-067448 proposes a sheet conveying apparatus adopting a registration process that makes it possible to automatically correct skew of a sheet.

Here, this sheet conveying apparatus includes a conveying roller pair (registration roller pair) that nips and conveys a sheet, a sensor for detecting a skew amount of a sheet, which is provided on a downstream side in a conveying direction of the conveying roller pair, and conveying roller pair inclination correcting means for displacing the conveying roller pair to be inclined in a direction orthogonal to the conveying direction of the sheet. In the case in which skew conveying of the sheet is corrected, the conveying roller pair is displaced in accordance with the skew of the sheet on the basis of information of the skew amount detection sensor to correct the skew conveying of the sheet.

However, in such a conventional sheet conveying apparatus that displaces the conveying roller pair to correct skew of a sheet, when the conveying roller pair is displaced to perform skew conveying correction for a sheet, if a load is applied on a trailing edge side of the sheet, slight slippage occurs in the conveying roller pair at the time of sheet rotation. Thus, a skew conveying correction accuracy is deteriorated. In addition, if the load on the trailing edge is large, the sheet may be wrinkled, buckled, or torn.

Moreover, in recent years, in order to reduce a size of the image forming apparatus, a sheet conveying path on an upstream side of the conveying roller pair is often formed in a curved shape. In the case in which the sheet conveying path is curved in this way, in particular, when the sheet such as thick paper with high rigidity (stiffness) is rotated, if a trailing edge of the sheet is in the sheet conveying path, a frictional force between the sheet and a guide member constituting the sheet conveying path increases, and the skew conveying correction accuracy is further deteriorated.

SUMMARY OF THE INVENTION

Therefore, the present invention has been made in view of the aforementioned circumstances, and it is an object of the present invention to provide a sheet conveying apparatus, an image forming apparatus, and an image reading apparatus that can improve sheet correction accuracy.

The present invention provides a sheet conveying apparatus for conveying a sheet using sheet conveying means arranged along a sheet conveying path, including:

skew detecting means for detecting skew of the sheet conveyed along the sheet conveying path with respect to a sheet conveying direction;

skew correcting means that moves in a direction for correcting the skew of the skewed sheet with the sheet nipped therein on the basis of a detection signal from the skew detecting means; and guide means for regulating side edges of the sheet and guiding the sheet to the skew correcting means, in which, when the skew correcting means moves in the direction for correcting the skew of the sheet, the guide means is moved in the direction for correcting the skew of the sheet.

DESCRIPTION OF THE PREFERRED EMBODIMENTS

Embodiments of the present invention will be hereinafter explained in detail with reference to the accompanying drawings.

Figure 1:
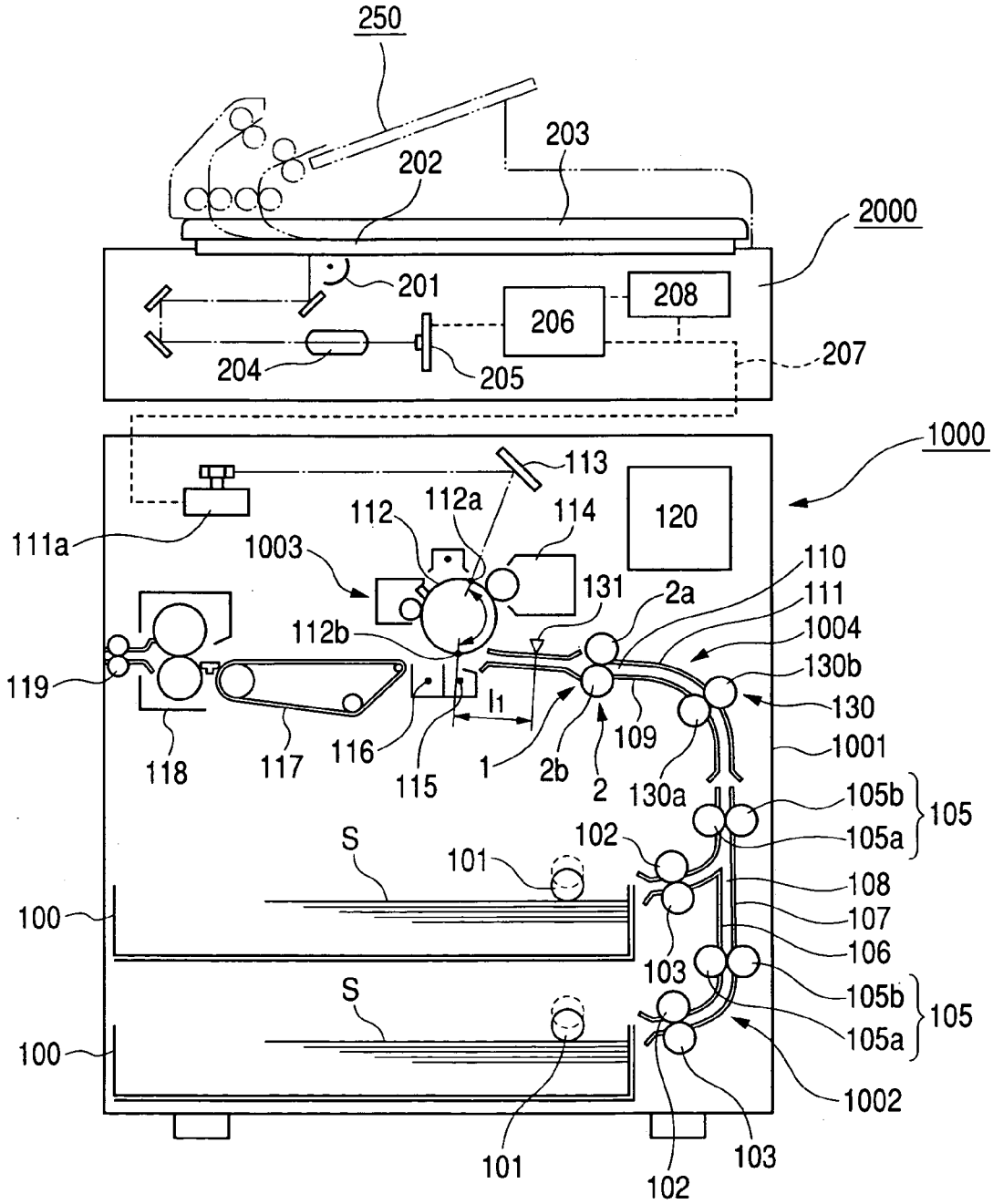
FIG. 1 is a sectional view of a printer that is an example of an image forming apparatus including a sheet conveying apparatus in accordance with a first embodiment of the present invention.

FIG. 1 is a sectional view of a printer that is an example of an image forming apparatus including a sheet conveying apparatus in accordance with a first embodiment of the present invention.

In the figure, reference numeral 1000 denotes a printer. The printer 1000 includes a printer main body 1001 and a scanner 2000 that is arranged on an upper surface of the printer main body 1001.

Here, the scanner 2000 for reading an original includes a scanning optical system light source 201, a platen glass 202, an original pressing plate 203 that opens and closes, a lens 204, a light-receiving element (photoelectrical conversion element) 205, an image processing portion 206, a memory portion 208 for storing an image processing signal of an image processed in the image processing portion 206, and the like.

In reading an original, the scanner 2000 reads the original such that an original (not shown) placed on the platen glass 202 is irradiated with light from the scanning optical system light source 201. A read image of the original is processed by the image processing portion 206, and then converted into an electric signal 207, which is electrically coded, and transmitted to a laser scanner 111*a* serving as image creating means. Note that it is possible to store image information of an image processed by the image processing portion 206, which is coded, in the memory portion 208 temporarily and transmit the image information to the laser scanner 111*a* as required according to a signal from a controller 120.

The printer main body 1001 includes a sheet feeding apparatus 1002 that feeds sheets S, a sheet conveying apparatus 1004 that conveys the sheets S fed by the sheet feeding apparatus 1002 to an image forming portion 1003, a controller 120 serving as control means for controlling the printer 1000, and the like. Here, the sheet feeding apparatus 1002 includes sheet feeding cassettes 100, pickup rollers 101, and separating portions including feed rollers 102 and retard rollers 103. The sheets S in the sheet feeding cassettes 100 are separated and fed one by one by the action of the pickup rollers 101, which move up and down/rotate at a predetermined timing, and the separating portions.

The sheet conveying apparatus 1004 includes a conveying roller pair 105 and a skew correction roller portion 1 that has an upstream roller pair 130 and a skew correction roller pair 2. The sheet S fed from the sheet feeding apparatus 1002 is passed through a sheet conveying path 108, which is constituted by guides 106 and 107, by the conveying roller pair 105, and then passed to a sheet conveying path 110, which is constituted by guides 109 and 111 serving as guide means, and guided to the skew correction roller portion 1. Then, after skew conveying and positional deviation are corrected in the skew correction roller portion 1 as described later, the sheet S is conveyed to the image forming portion 1003.

The image forming portion 1003 includes a photosensitive drum 112, a laser scanner 111*a*, a developing device 114, a transfer charger 115, a separating charger 116, and the like. At the time of image formation, a laser beam from the laser scanner 111*a* is returned by a mirror 113 and applied onto an exposing position 112*a* on a photosensitive drum rotating in a clockwise direction, whereby a latent image is formed on the photosensitive drum. Thereafter, the latent image formed on the photosensitive drum in this way is visualized as a toner image by the developing device 114.

Note that, thereafter, the toner image on the photosensitive drum is transferred onto the sheet S by the transfer charger 115 in a transfer portion 112*b*. The sheet S having the toner image transferred thereon in this way is electrostatically separated from the photosensitive drum 112 by the separating charger 116. Then, the sheet S is conveyed to a fixing device 118 by a conveying belt 117, and the toner image is fixed thereon. Thereafter, the sheet S is discharged by a discharge roller 119.

Note that, in the figure, reference numeral 131 denotes an exposing start sensor that detects the sheet S having passed the skew correction roller pair 2. When the exposing start sensor 131 detects the sheet S having passed the skew correction roller pair 2, irradiation of a laser beam by the laser scanner 111*a* is started.

Here, the exposing start sensor 131 is arranged such that a distance 11 from the exposing start sensor 131 to the transfer portion 112*b* is equal to a distance 10 from the laser beam irradiation position 112*a* of the photosensitive drum 112 to the transfer portion 112*b*. This makes it possible to synchronize the sheet S and a top position of the image on the photosensitive drum 112.

Note that, in this embodiment, the printer main body 1001 and the scanner 2000 are separated. However, the printer main body 1001 and the scanner 2000 may be integrated. In addition, regardless of whether the printer main body 1001 is separated from or integrated with the scanner 2000, the printer main body 1001 functions as a copying machine if a processing signal of the scanner 2000 is inputted to the. laser scanner 111*a* and functions as a facsimile machine if a transmission signal of a facsimile machine is inputted thereto. The printer main body 1001 functions as a printer if an output signal of a personal computer is inputted thereto.

Conversely, the printer main body 1001 functions as a facsimile machine if a processing signal of the image processing portion 206 of the scanner 2000 is fed to another facsimile machine. In addition, if an automatic original feeder 250 indicated by the chain double-dashed line is mounted instead of the original pressing plate 203 in the scanner 2000, the scanner 2000 can automatically read an original.

Figure 2:
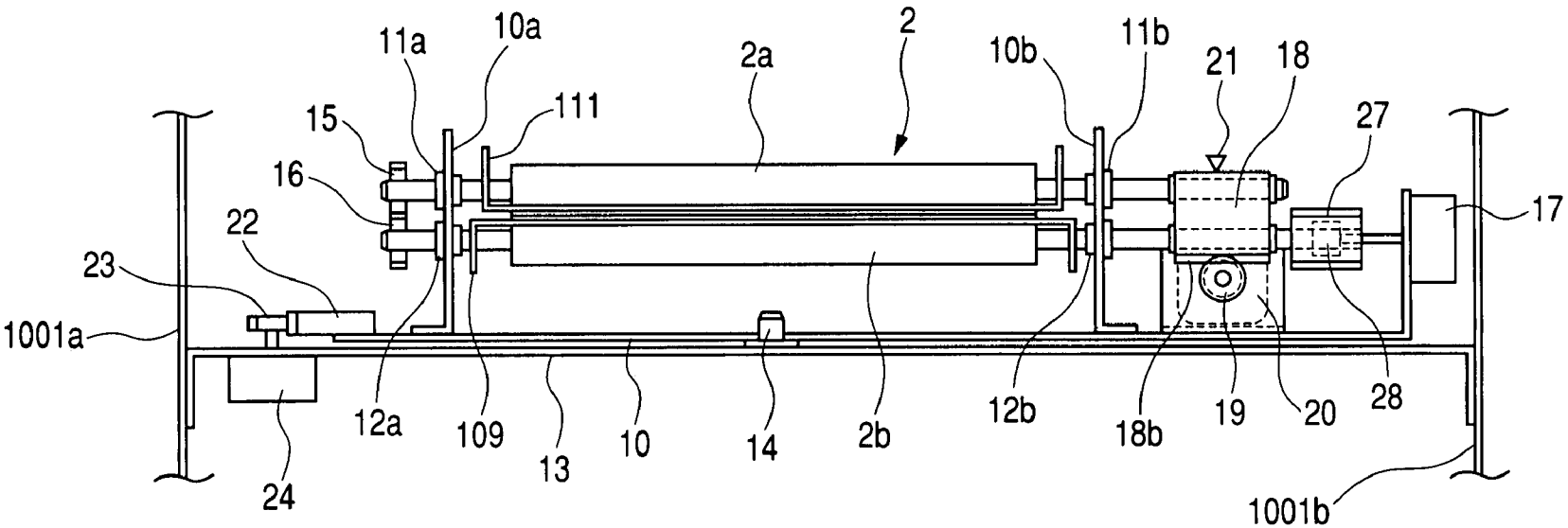
FIG. 2 is a. side view of a skew correction roller portion of the sheet conveying apparatus.
Figure 3:
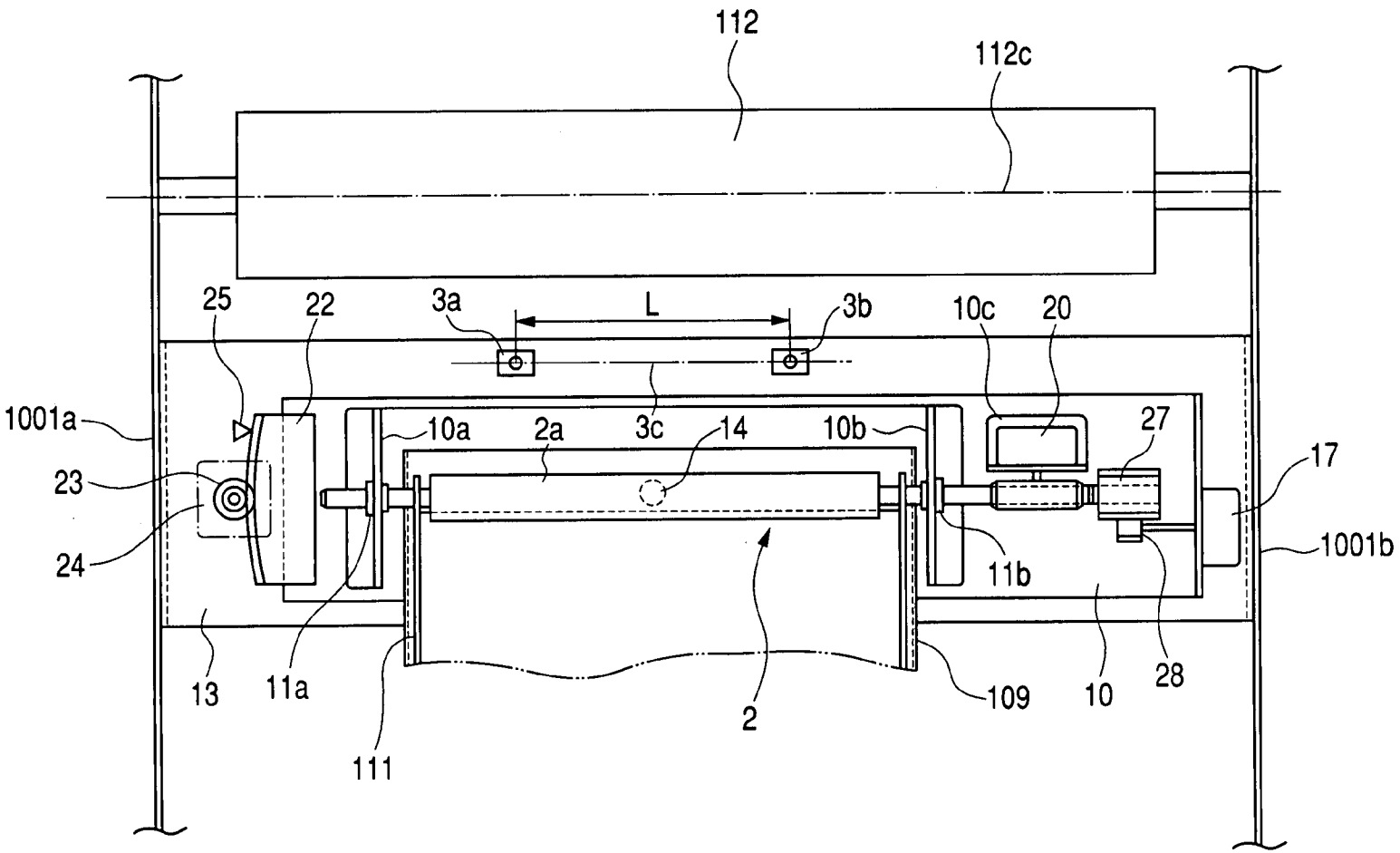
FIG. 3 is a plan view of the skew correction roller portion of the sheet conveying apparatus.

FIG. 2 is a side view of the skew correction roller portion 1, and FIG. 3 is a plan view thereof.

As shown in FIGS. 2 and 3, the skew correction roller pair 2 serving as skew correcting means is constituted by two skew correction rollers 2*a* and 2*b*. The skew correction rollers 2*a* and 2*b* are rotatably supported by bearings 11*a*, 11*b*, 12*a* and 12*b*, which are fixed to side plates 10*a* and 10*b* vertically provided on a frame 10, respectively.

Note that the upper skew correction roller 2*a* is pressed against the lower skew correction roller 2*b* by a pressure spring (not shown). In addition, gears 15 and 16 are attached to one sides of the skew correction rollers 2*a* and 2*b*, respectively. The skew correction roller pair 2 (2*a* and 2*b*) is constituted so as to rotate in synchronization with each other by the gears 15 and 16.

Moreover, a drive input gear 27 is fixed to a shaft end of the lower skew correction roller 2*b*, and a gear 28 fixed to an output shaft of a drive motor 17 engages with the drive input gear 27. Consequently, when the drive motor 17 is driven, the skew correction roller pair 2 rotates.

Guides 109 and 111, which constitute sidewall surfaces of the sheet conveying path 110 and guide the sheet S to the skew correction roller pair 2, are pivotally supported to shafts of the skew correction rollers 2*a* and 2*b*. Note that movement of the guides 109 and 111 in a thrust direction, which is a direction orthogonal to a sheet conveying direction P, is regulated by a regulating member (not shown).

On a drive motor side that is one end side of the skew correction roller pair 2, a coupling member 18 is provided, which couples the skew correction rollers 2*a* and 2*b* and regulates movement of the skew correction rollers 2*a* and 2*b* in an axial direction. Then, the coupling member 18 supports the respective skew correction rollers 2*a* and 2*b* rotatably, a rack gear portion 18*b* is provided on a bottom surface thereof, and a pinion gear 19 fixed to an output shaft of a lateral moving motor 20 engages with the rack gear portion 19*b*.

Consequently, for example, when the pinion gear 19 rotates in the clockwise direction, the coupling member 18 moves to the right in FIG. 2, and the skew correction roller pair 2 moves in the thrust direction integrally with the guides 109 and 111 following the movement of the coupling member 18. In other words, by driving the lateral moving motor 20, the skew correction roller pair 2 and the guides 109 and 111 can be moved in the thrust direction.

Note that, in FIG. 2, reference numeral 21 denotes a first home position sensor. A first home position in the thrust direction of the skew correction roller pair 2 can be detected by the first home position sensor 2.

On the other hand, the frame 10 is attached pivotally around a pivotal shaft 14 that is provided in a stay 13 fixed between a front side plate 1001*a* and a rear side plate 1001*b* of the printer main body 1001. Note that the pivotal shaft 14 serves as a center of a pivotal motion at the time of skew correction of the skew correction roller pair 2 to be described later and also serves as a reference position on the shaft of the skew correction roller pair 2.

In addition, a gear 22 is fixed on the side of the front side plate of the frame 10. The gear 22 engages with a rack gear 23 that is fixed to an output shaft of a rotating motor 24 attached to the stay 13.

When the rotating motor 24 rotates and, for example, the rack gear 23 rotates in the clockwise direction in FIG. 3, the frame 10 and all the members attached on the frame 10 including the skew correction roller pair 2, the drive motor 17, the guides 109 and 111, and the like pivot in the counterclockwise direction around the pivotal shaft 14.

In other words, the skew correction roller pair 2 and the guides 109 and 111 can be displaced (rotated) integrally by the rotation of the rotating motor 24 so as to be inclined with respect to the thrust direction. Note that, in FIG. 3, reference numeral 25 denotes a second home position sensor provided on the stay 13. A second home position in a rotating (pivoting) direction, in which a nip line of the skew correction roller pair 2 is in parallel with a rotation center axis 112*c* of a photosensitive drum 112, is detected by the second home position sensor 25.

In FIG. 3, reference symbols 3*a* and 3*b* denote skew conveying detection sensors serving as skew detecting means for detecting skew of the leading edge of the sheet S. The skew conveying detection sensors 3*a* and 3*b* are disposed on a downstream side in the conveying direction of the skew correction roller pair 2 at a predetermined interval L in a direction orthogonal to the sheet conveying direction. Note that a central line 3*c* connecting the skew conveying detection sensors 3*a* and 3*b* is arranged so as to be parallel with the axial line 112*c* of the photosensitive drum 112 provided on the downstream side in the conveying direction.

Figure 4:
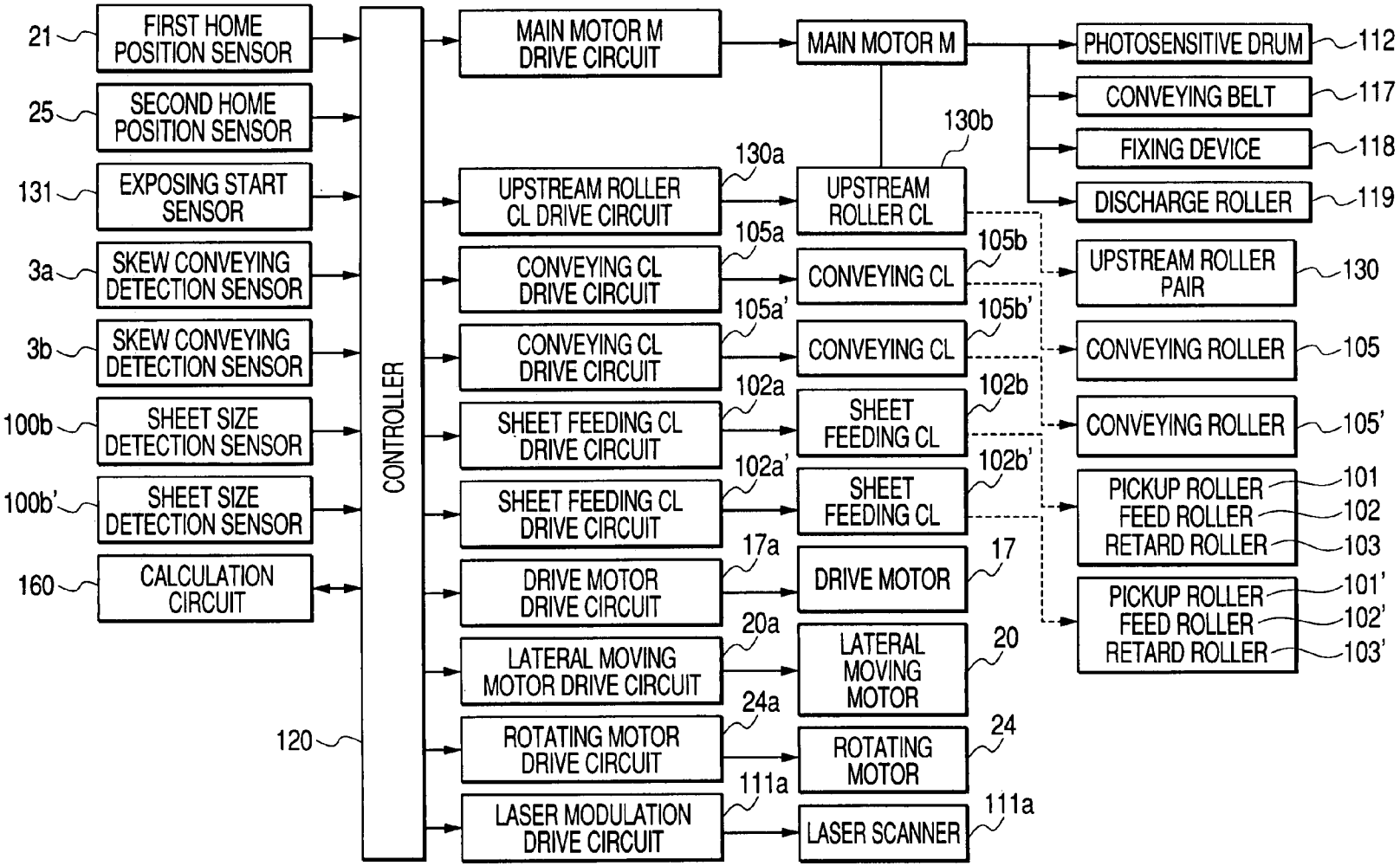
FIG. 4 is a control block diagram of the printer.
Figure 5:
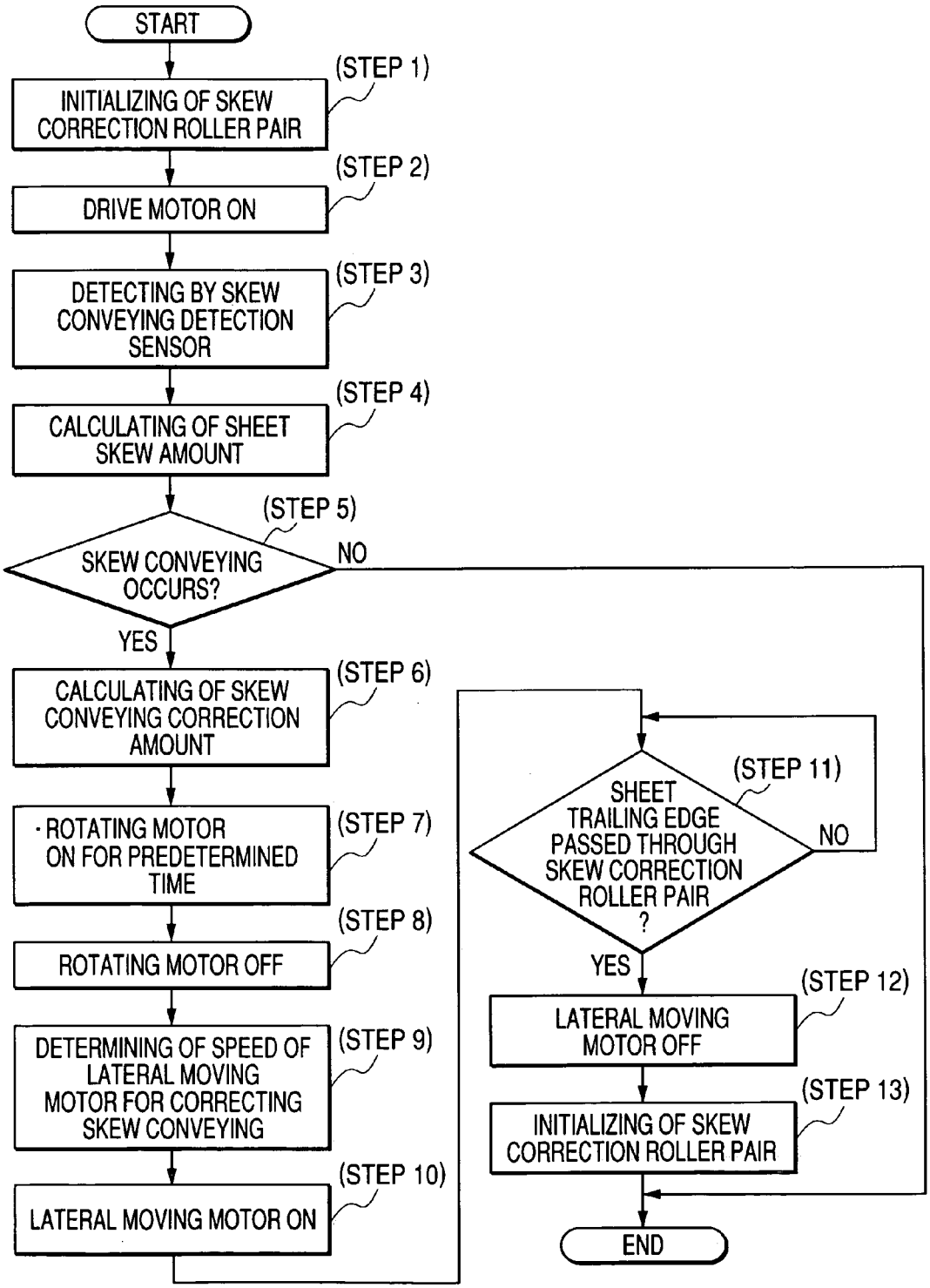
FIG. 5 is a flowchart explaining a skew conveying correction operation of the sheet conveying apparatus.

FIG. 4 is a control block diagram of the printer 1000 including the sheet conveying apparatus 1004 and the like. As shown in the figure, the photosensitive drum 112, the conveying drum 117,. the fixing device 118, and the discharge roller 119 are directly connected to a main motor M so as to be rotatable in synchronization with the main motor M, respectively. In addition, the pickup rollers 101, the feed rollers 102, the retard rollers 103, the conveying roller 105, and the upstream roller pair 130 receive a driving force from the main motor M, and are controlled in terms of driving by clutches 102*b*, 105*b*, and 130*b* that are subjected to ON/OFF control via drive circuits 102*a*, 105*a*, and 130*a* therefor according to a signal from the controller 120.

In addition, sheet size detection signals from sheet size detection sensors 100*b* and 100*b*' mounted on the sheet feeding cassette 100, detection signals from the skew conveying detection sensors 3*a* and 3*b*, and signals from the first home position sensor 21 and the second home position sensor 25 are inputted to the controller 120 serving as control means, respectively. In the controller 120, a calculation circuit 160 calculates a skew amount of the sheet S on the basis of, for example, the detection signals from the skew conveying detection sensors 3*a* and 3*b*.

Moreover, the controller 120 outputs a necessary control signal based on a detection result to drive circuits 17*a*, 20*a*, 24*a*, and 111*a* and drives the drive motor 17, the lateral moving motor 20, the rotating motor 24, and the laser scanner 111*a* by a predetermined amount or for a predetermined time via the drive circuits 17*a*, 20*a*, 24*a*, and 111*a*.

Next, a skew conveying correction operation of the printer 1000 (sheet conveying apparatus 1004) with such a structure will be explained with reference to a flowchart of FIG. 5 and FIGS. 6A to 6D.

First, when a start button (not shown) of the printer 1000 is pressed, the lateral moving motor 20 and the rotating motor 24 are driven, to perform an initializing operation in a rotating direction and a thrust direction of the skew correction roller pair 2 with the first home position sensor 21 and the second home position sensor 25 (step S1).

Figure 6A:
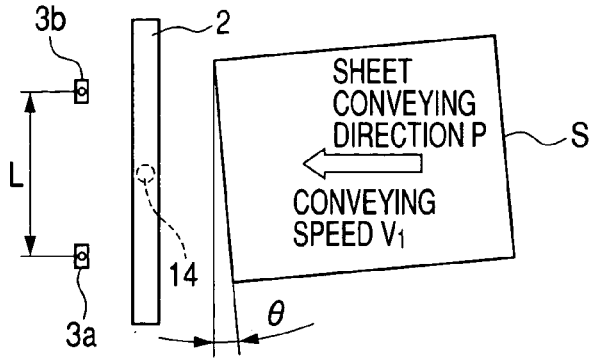
FIGS. 6A, 6B, 6C and 6D are first diagrams illustrating the skew conveying correction operation of the sheet conveying apparatus.
Figure 6B:
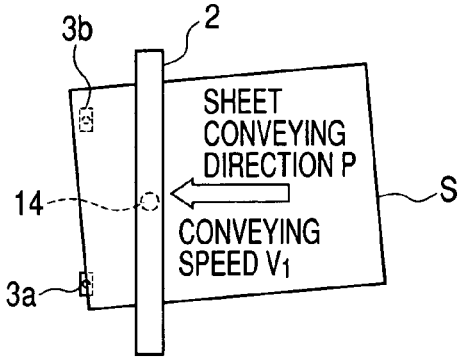

Then, after this initializing operation, the drive motor 17 is driven (turned ON), and the skew correction roller pair 2 starts rotation (step S2). Here, after the sheet S, which is skew-conveyed by the angle θ with respect to the sheet conveying direction P as shown in FIG. 6A, is conveyed to the skew correction roller pair 2 that has started rotation, the sheet S soon enters the nip portion of the skew correction roller pair 2 to be nipped by the skew correction roller pair 2.

Subsequently, the sheet S nipped by the skew correction roller pair 2 is fed and moves forward along the sheet conveying direction P in the skewed state. Thus, the sheet S is detected by the skew conveying detection sensors 3*a* and 3*b* that are arranged on the downstream side of the skew correction roller pair 2 (step S3).

Here, detection signals from the skew conveying detection sensors 3*a* and 3*b* are inputted to the controller 120. A passing point in time of the leading edge of the sheet and a skew amount of the sheet S nipped by the skew correction roller pair 2 are determined and calculated by the calculation circuit 160 (step S4).

Next, the controller 120 judges whether skew conveying of the sheet S has occurred from a result of this calculation (step S5). If skew conveying of the sheet S has not occurred (N in step S5), the controller 120 does not perform a correction operation. If skew conveying of the sheet S has occurred (Y in step S5), the controller 120 calculates a skew conveying correction amount for the skew conveying, that is, drive amounts of the rotating motor 24 (step S6).

Figure 6C:
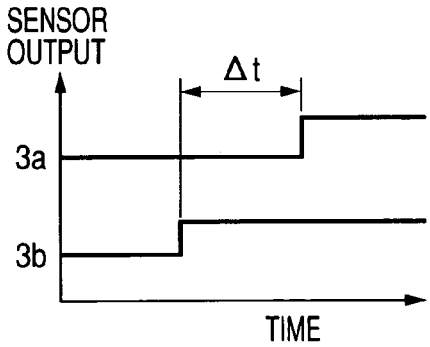
Figure 6D:
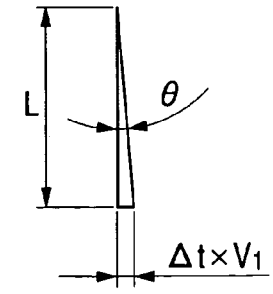

Here, for example, in the case in which a difference between detection timing of the skew conveying detection sensor 3*a* and detection timing of the skew conveying detection sensor 3*b* is Δt as shown in FIG. 6C, when it is assumed that a conveying speed of the sheet S is V1 and a pitch (distance between sensors) of the skew conveying detection sensors 3*a* and 3*b* is L, a skew amount θ of the sheet S can be calculated by the following expression as is apparent from FIG. 6D.

$$\theta=\tan^{-1}(\Delta t\times V1/L) \quad (1)$$

Figure 7A:
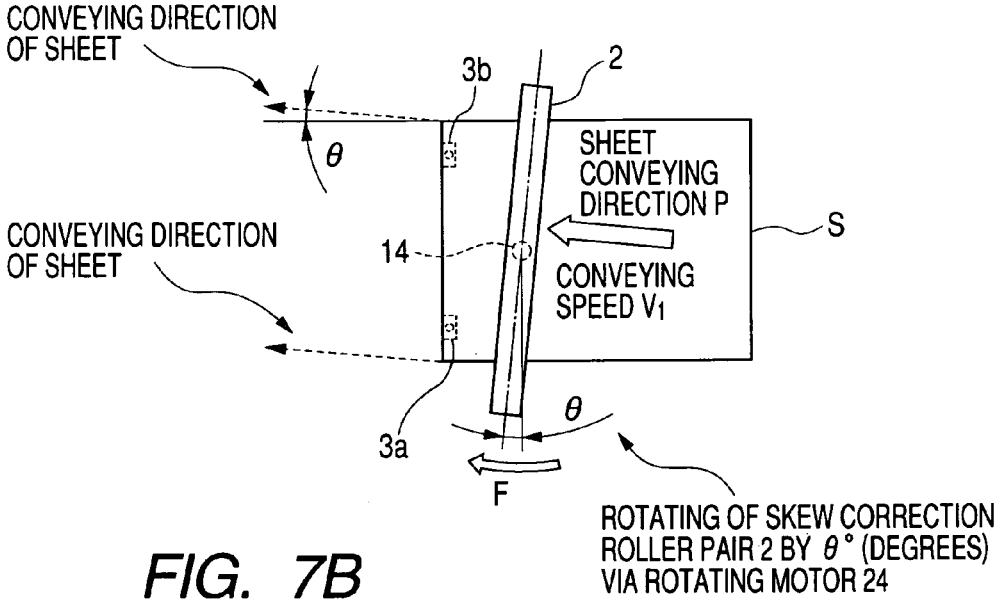
FIGS. 7A, 7B and 7C are second diagrams illustrating the skew conveying correction operation of the sheet conveying apparatus.

Thereafter, the rotating motor 24 is driven (turned ON) for a predetermined time according to the skew amount θ of the sheet S calculated based on Expression 1 above. Here, the rotating motor 24 is driven for the predetermined time according to the skew amount θ of the sheet S in this way, whereby as shown in FIG. 7A, the skew correction roller pair 2 pivots by the angle θ in a direction of the arrow F around the pivotal shaft 14 to bring the leading edge of the sheet S nipped by the skew correction roller pair 2 into a state of being parallel with the axial direction of the transfer portion 112*b* (axial direction of the photosensitive drum).

Note that, in the case in which the skew correction roller pair 2 pivots in this way, the conveying direction of the sheet S to be conveyed by the skew correction roller pair 2 is also inclined by the same angle (θ) compared with the original direction. As a result, the entire sheet is fed (hereinafter, referred to as "skew-fed") in an oblique direction indicated by the dashed line at the inclined angle (θ).

Figure 7B:
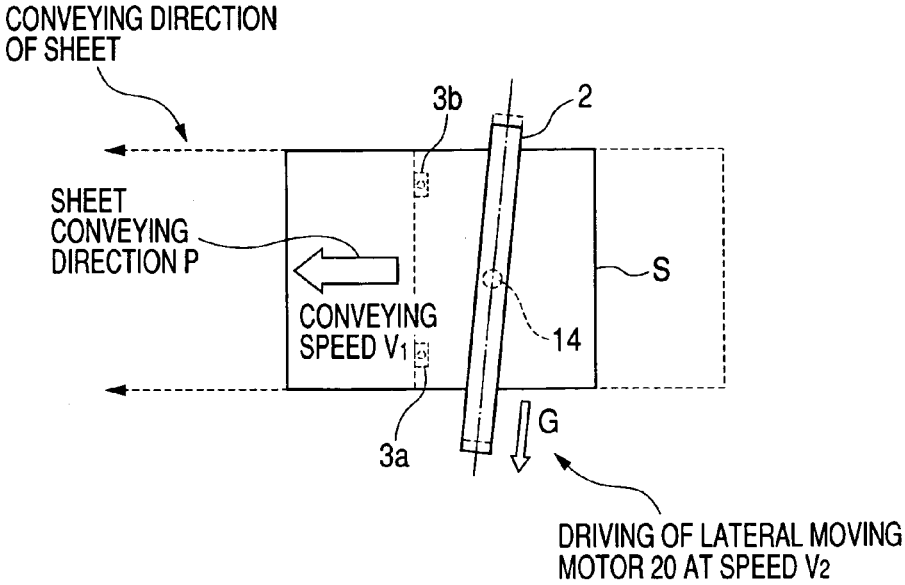

Thus, in this embodiment, after rotating and moving the skew correction roller pair 2 and the guides 109 and 111 integrally by the angle θ as described above, the rotating motor 24 is turned OFF (step S8). Thereafter, the lateral moving motor 20 is driven so as to move the skew correction roller pair 2 and the guides 109 and 111 in a direction of the arrow G shown in FIG. 7B.

Figure 7C:
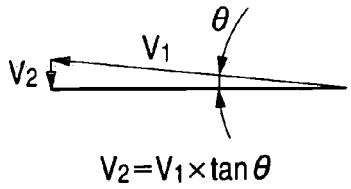

Here, in this case, the sheet S is skew-fed at a conveying speed V1 by the skew correction roller pair 2 in a state in which the sheet S is skewed by the angle θ with respect to the transfer portion 112*b*. Thus, in order to convey the skew-fed sheet S in the original sheet conveying direction, a moving speed V2 in the thrust direction of the skew correction roller pair 2 and the guides 109 and 111 moved by the lateral moving motor 20 is set as follows as shown in FIG. 7C.

$$V2=V1\times\tan\theta \quad (2)$$

Thus, after a speed of the lateral moving motor 20 for skew feeding correction is determined based on Expression 2 above (step S9), the lateral moving motor 20 is driven (turned ON) (step S10). As a result, the skew feeding of the sheet S can be corrected, and the sheet S can be conveyed in the original sheet conveying direction.

Consequently, skew conveying/skew feeding correction for the sheet S can be performed. After that, when the trailing edge of the sheet S has passed through the skew correction roller pair 2 (Y in step S11), the lateral moving motor is stopped (turned OFF) (step S12).

Since the correction operation described above is performed, the sheet S is not skewed with respect to the transfer portion 112*b* and delivered in an accurate conveying posture. Thereafter, a toner image is transferred onto the sheet S. Then, an initializing operation for the skew correction roller pair 2, and the guides 109 and 111 is performed (step S13) to prepare for skew conveying/skew feeding correction for the next sheet S. Note that this initializing operation is performed on the basis of signals from the first home position sensor 21 and the second home position sensor 25 as described earlier.

As described above, skew of the sheet S is detected, the skew correction roller pair 2 is pivoted according to a skew amount of the sheet, and the skew correction roller pair 2 is then moved in a thrust direction by the lateral moving motor 20, upstream roller pair 130A is moved in the thrust direction while conveying the sheet S, so that highly accurate skew conveying/skew feeding correction for the sheet S can be performed very smoothly without temporarily stopping the sheet S.

In addition, in performing skew conveying correction for the sheet S as in this embodiment, by integrally pivoting (moving) the skew correction roller pair 2 and the guides 109 and 111, a load is prevented from being applied to a sheet trailing edge side at the time of sheet rotation. Consequently, slippage of the sheet S in the skew correction roller pair 2, occurrences of wrinkles in the sheet S, and occurrence of buckling, tearing, and the like of the sheet S, which are caused by the load on the trailing edge side of the sheet S can be prevented, and more accurate skew conveying correction can be performed.

Note that, in this embodiment, the skew correction roller pair 2 and the guides 109 and 111 are moved in a thrusting manner by the single lateral moving motor 20 and are rotated by the single rotating motor 24. However, the skew correction roller pair 2 and the guides 109 and 111 may be operated by dedicated drive sources such as motors, respectively. With this structure, since a drive load of the lateral moving motor 20 or the rotating motor 24 is reduced, it becomes possible to perform the thrust control or the rotation control in a short time.

Figure 8:
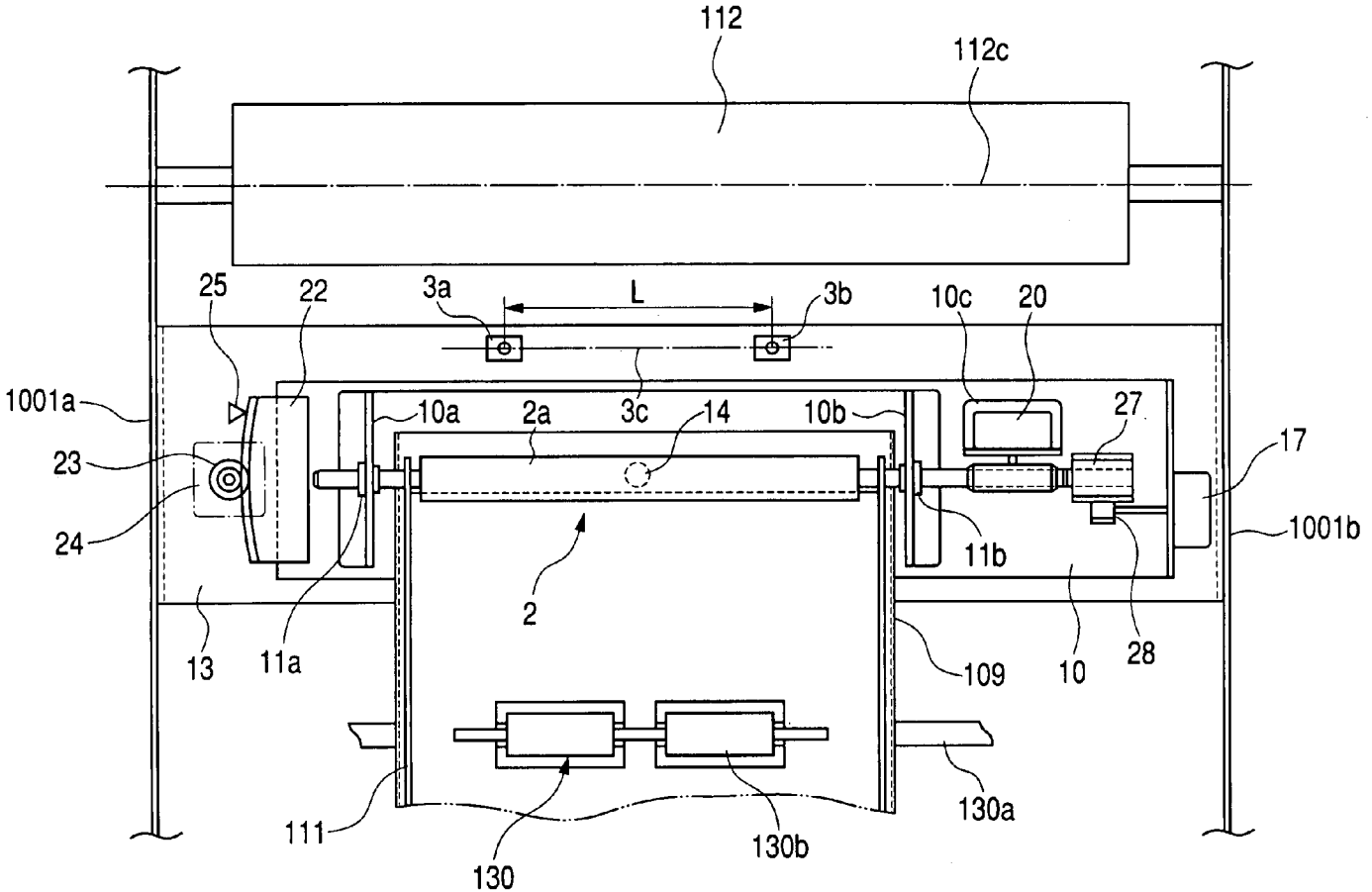
FIG. 8 is a plan view illustrating another structure of the skew correction roller portion of the sheet conveying apparatus.

Moreover, as shown in FIG. 8, the upstream roller pair 130, which is sheet conveying means provided upstream of the skew correction roller pair 2, may be rotatably provided in the guides 109 and 111 such that the upstream roller pair 130 is also operated integrally with the skew correction roller pair 2 and the guides 109 and 111. With such a structure, a load on the sheet trailing edge side at the time of skew conveying/skew feeding correction can be further reduced, and correction accuracy can be further improved.

Next, a second embodiment of the present invention will be explained.

Figure 9:
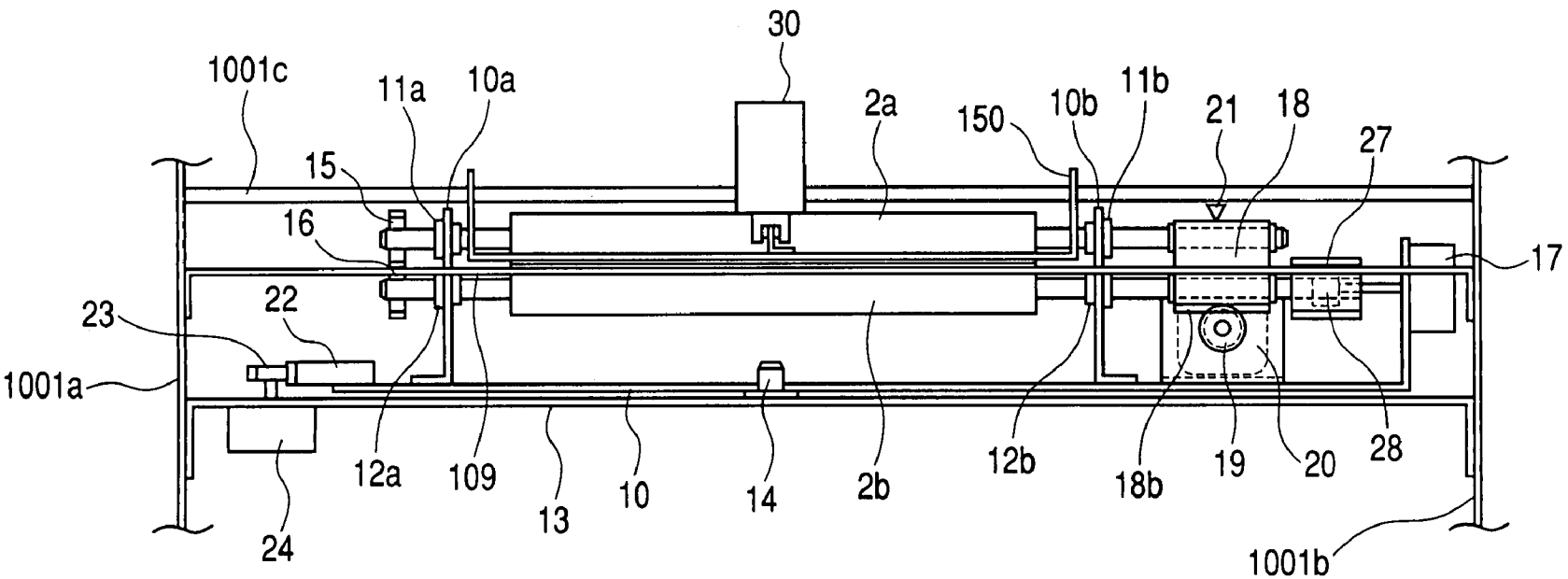
FIG. 9 is a side view of a skew correction roller portion of a sheet conveying apparatus in accordance with a second embodiment of the present invention.
Figure 10:
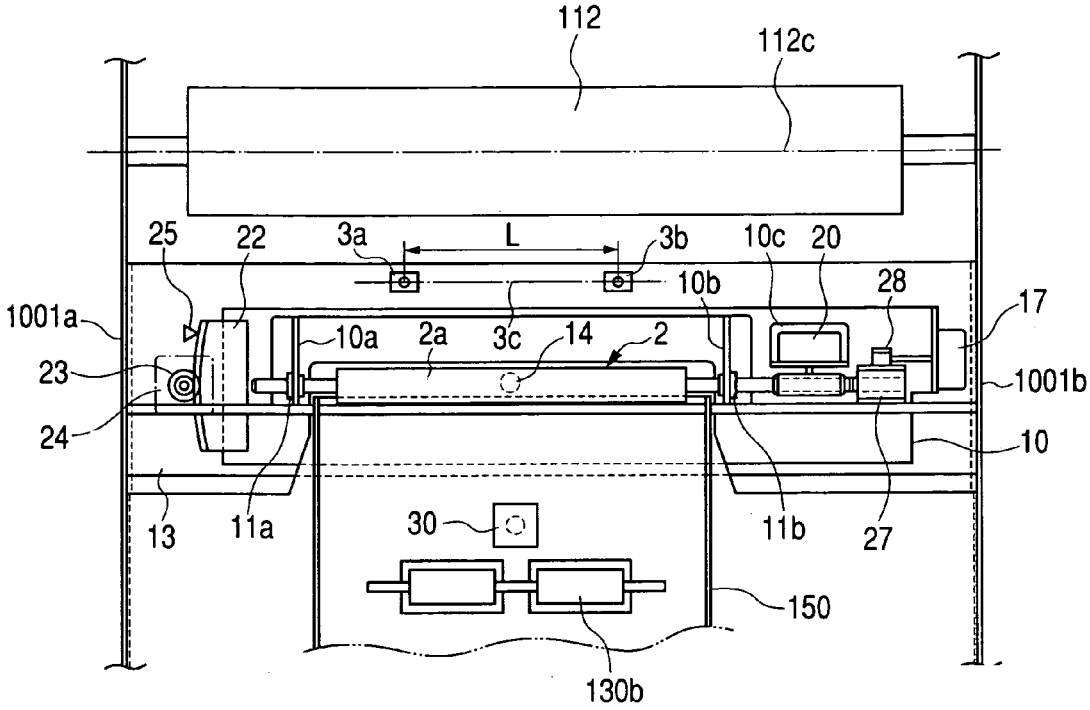
FIG. 10 is a plan view of the skew correction roller portion of the sheet conveying apparatus.

FIG. 9 is a side view of a skew correction roller portion of a sheet conveying apparatus in accordance with this embodiment, and FIG. 10 is a plan view of the same. Note that, in FIGS. 9 and 10, reference numerals and symbols identical with those in FIGS. 2 and 3 denote identical or equivalent portions.

In FIGS. 9 and 10, reference numeral 150 denotes an upper guide serving as guide means, which forms an upper surface of the sheet conveying path 110 that curves along the lower guide 109. The upper guide 150 is provided pivotally in the vertical direction with a stay shaft 1001*c* fixed to a front side plate 1001*a* and a rear side plate 1001*b* as a fulcrum. The upper upstream roller 130*b* of the two upstream rollers 130*a* and 130*b* constituting the upstream roller pair 130 is rotatably held in the upper guide 150.

Figure 11:
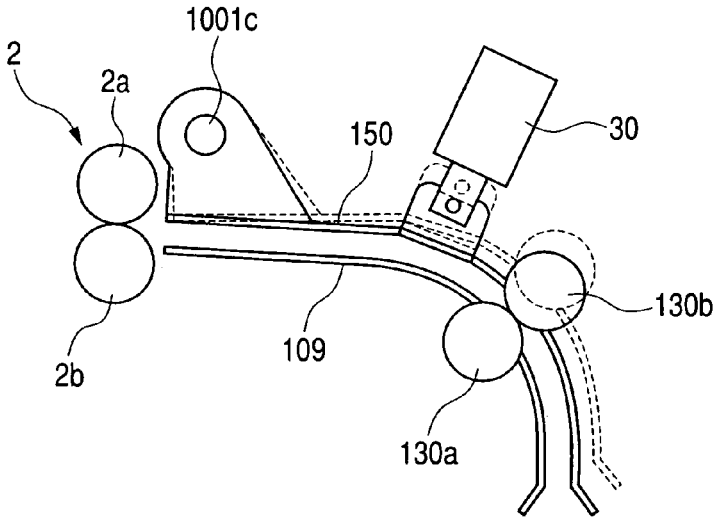
FIG. 11 is a diagram illustrating a structure of the skew correction roller portion of the sheet conveying apparatus.

Note that the upper guide 150 is biased in a direction of the lower guide 109 by biasing means (not shown) and is constituted to be held by a stopper (not shown) in a position indicated by the solid line in FIG. 11 where a predetermined gap can be secured between the upper guide 150 and the lower guide 109 and the upper upstream roller 130*b* is in press-contact with the lower upstream roller 130*a* with a predetermined pressure.

In addition, reference numeral 30 denotes a guide release solenoid that controls a position of the upper guide 150. When the guide release solenoid 30 is turned ON, the upper guide 150 pivots upward with the stay shaft 1001*c* as a fulcrum as indicated by the broken line, whereby the gap between the upper guide 150 and the lower guide 109 expands, and the nip of the upstream roller pair 130 is also released.

Figure 12:
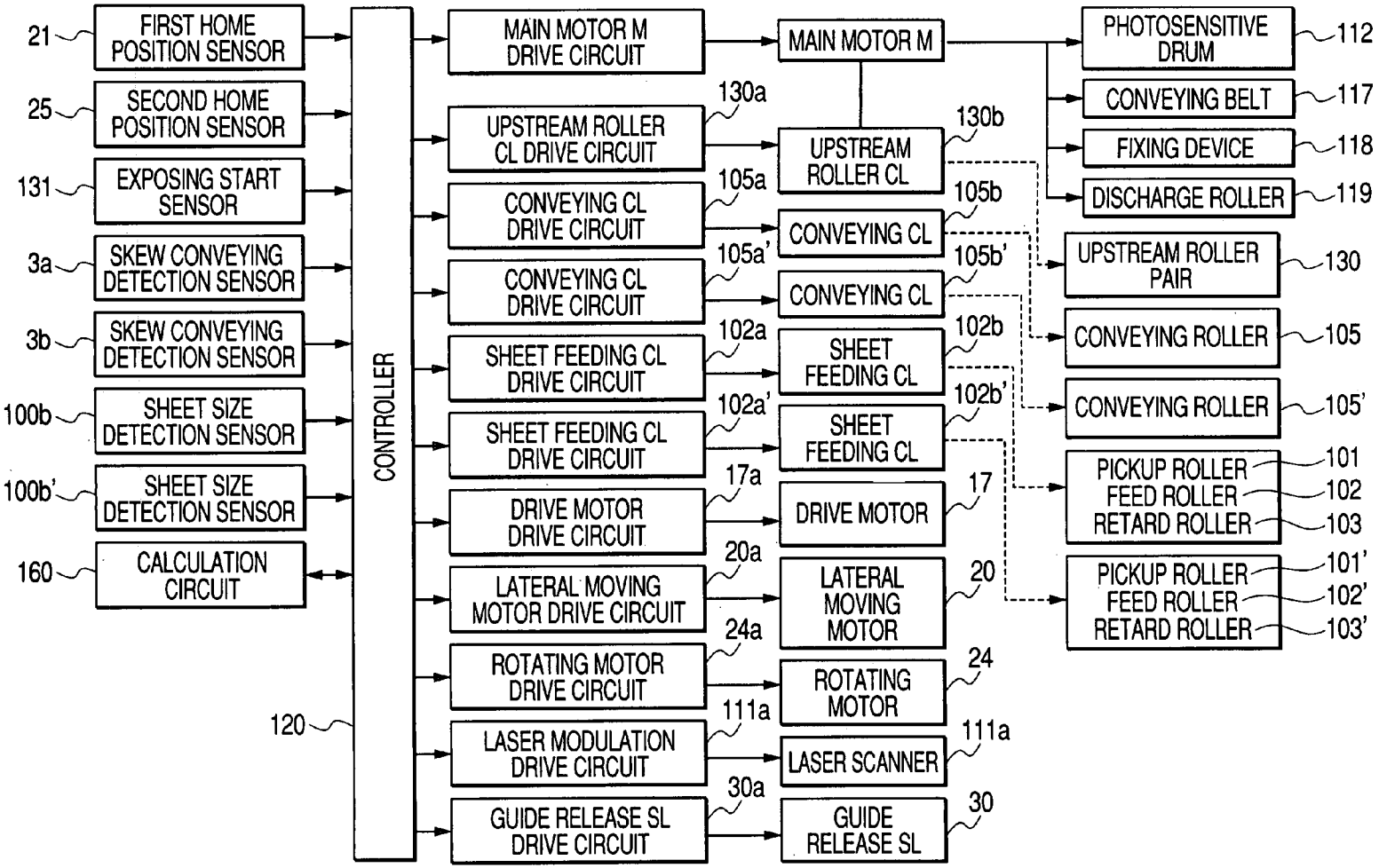
FIG. 12 is a control block diagram of a printer including the sheet conveying apparatus.
Figure 13:
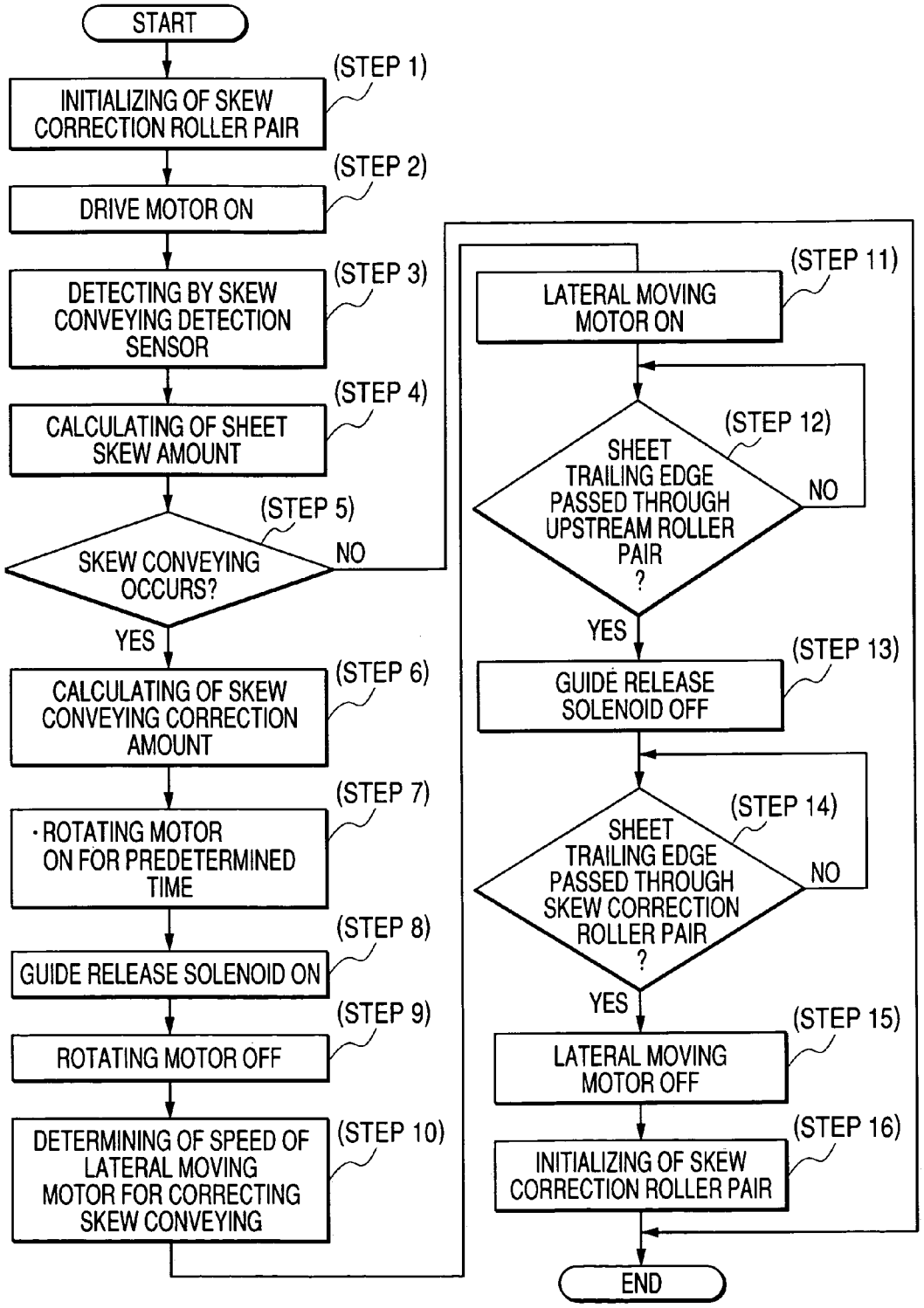
FIG. 13 is a flowchart explaining a skew conveying correction operation of the sheet conveying apparatus.

FIG. 12 is a control block diagram of the printer 1000 including the sheet conveying apparatus 1004 and the like. As shown in the figure, the guide release solenoid (SL) 30 is constituted such that ON/OFF control thereof is possible via a guide release solenoid drive circuit 30*a* to which a signal from the controller 120 is inputted.

Next, a skew conveying correction operation of the printer 1000 (sheet conveying apparatus 1004) with such a structure will be explained with reference to a flowchart of FIG. 13 and FIGS. 14A to 14C and 15A to 15D.

First, when a start button (not shown) of the printer 1000 is pressed, the lateral moving motor 20 and the rotating motor 24 are driven, to perform an initializing operation in a rotating direction and a thrust direction of the skew correction roller pair 2 with the first home position sensor 21 and the second home position sensor 25 (step S1).

Figure 14A:
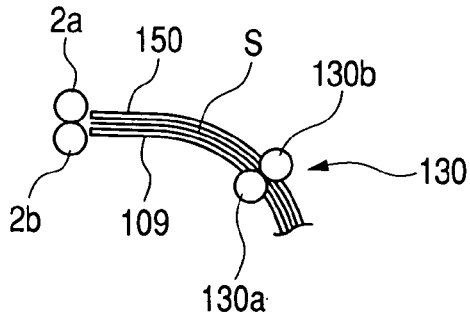
FIGS. 14A, 14B and 14C are first diagrams illustrating the skew conveying correction operation of the sheet conveying apparatus.

Then, after this initializing operation, the drive motor 17 is driven (turned ON), and the skew correction roller pair 2 starts rotation (step S2). Thereafter, as shown in FIG. 14A, the sheet S is conveyed to the skew correction roller pair 2 that has started rotation from the upstream roller pair 130 provided upstream of the skew correction roller pair 2.

Figure 14B:
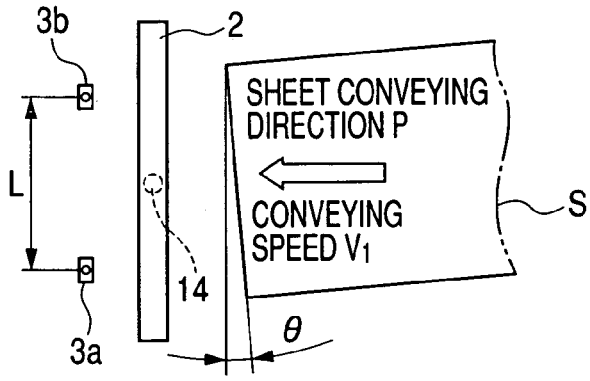

In this case, when being skew-conveyed by the angle θ with respect to the sheet conveying direction P as shown in FIG. 14B, the skew-conveyed sheet S enters the nip portion of the skew correction roller pair 2 and is nipped by the skew correction roller pair 2.

Figure 14C:
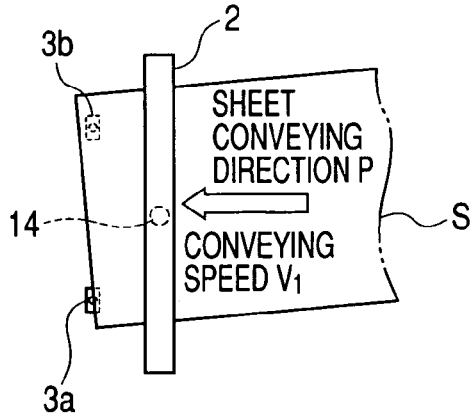

Next, the sheet S nipped by the skew correction roller pair 2 is fed and moves forward along the sheet conveying direction P in the skewed state. Thus, as shown in FIG. 14C, the sheet S is detected by the skew conveying detection sensors 3*a* and 3*b* that are arranged on the downstream side of the skew correction roller pair 2 (step S3). Note that at this time, the trailing edge of the sheet is in the curved sheet conveying path 110 as shown in FIG. 15D and nipped by the upstream roller pair 130.

Here, detection signals from the skew conveying detection sensors 3*a* and 3*b* are inputted to the controller 120. After that, a passing point in time of the leading edge of the sheet and a skew amount of the sheet S nipped by the skew correction roller pair 2 are determined and calculated by the calculation circuit 160 of the controller 120 (step S4).

Next, the controller 120 judges whether skew conveying of the sheet S has occurred from a result of this calculation (step S5) . If skew conveying of the sheet S has not occurred (N in step S5), the controller 120 does not perform a correction operation. If skew conveying of the sheet S has occurred (Y in step S5), the controller 120 calculates a skew conveying correction amount for the skew conveying, that is, drive amounts of the rotating motor 24 (step S6) according to Expression 1 above.

Here, the rotating motor 24 is driven (turned ON) according to the calculated skew amount θ of the sheet (step S7). By driving the rotating motor 24 for the predetermined time in this way according to the skew amount of the sheet S, as shown in FIG. 15A, the skew correction roller pair 2 pivots by the angle θ in a direction of the arrow F around the pivotal shaft 14 to bring the leading edge of the sheet S nipped by the skew correction roller pair 2 into a state of being parallel with the axial direction of the transfer portion 112*b* (axial direction of the photosensitive drum).

In addition, simultaneously with this, the guide release solenoid 30 is turned ON (step S8) to pivot the upper guide 150 upward. Consequently, as shown in FIG. 15B, the upper upstream roller 130*b* of the upstream roller pair 130, which has been in press-contact with the lower upstream roller 130*a* to nip the sheet S, rises to release the sheet nipping state of the upstream roller pair 130.

In this way, when the skew correction roller pair 2 is pivoted, the upper guide 150 is pivoted upward and the sheet nipping state of the upstream roller pair 130 is released. Consequently, at the time of sheet rotation, the upstream roller pair 130 can be prevented form applying a load to the trailing edge side of the sheet S, and the trailing edge side of the sheet S can be prevented from coming into press contact with the upper guide 150 due to the rigidity of the sheet S.

Figure 15A:
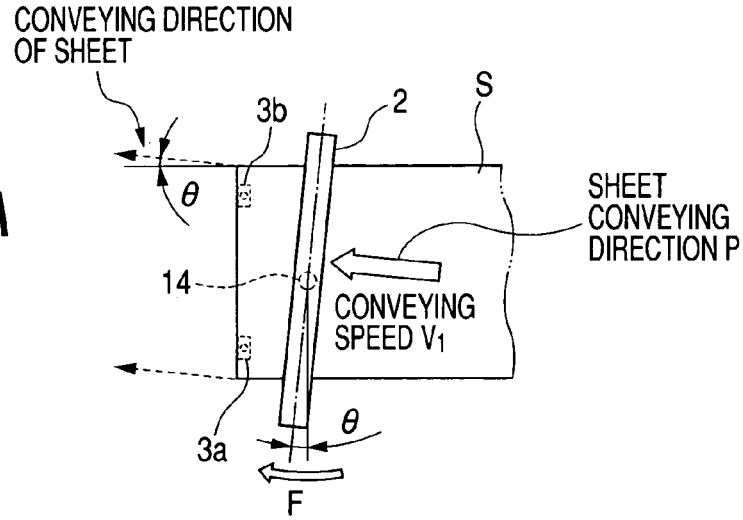
FIGS. 15A, 15B, 15C and 15D are second diagrams illustrating the skew conveying correction operation of the sheet conveying apparatus.
Figure 15B:
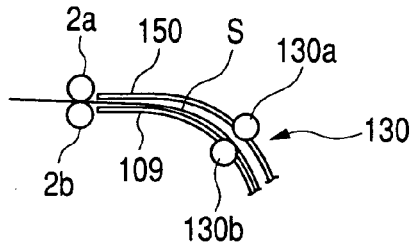

Meanwhile, in the case in which the skew correction roller pair 2 pivots as described above, the conveying direction of the sheet S to be conveyed by the skew correction roller pair 2 is also inclined by the same angle (θ) compared with the original direction as shown in FIG. 15A. As a result, the entire sheet is skew-fed in an oblique direction indicated by the dashed line at the inclined angle (θ).

Then, in this state, when the upstream roller pair 130 is restored to the sheet nipping state, a conveying direction of the upstream roller pair 130 and a conveying direction of the skew correction roller pair 2 are different by the angle θ. Thus, the sheet S is pulled and pushed between the upstream roller pair 130 and the skew correction roller pair 2. Consequently, at this point, the guide release solenoid 30 is kept ON as shown in FIG. 15B.

Figure 15C:
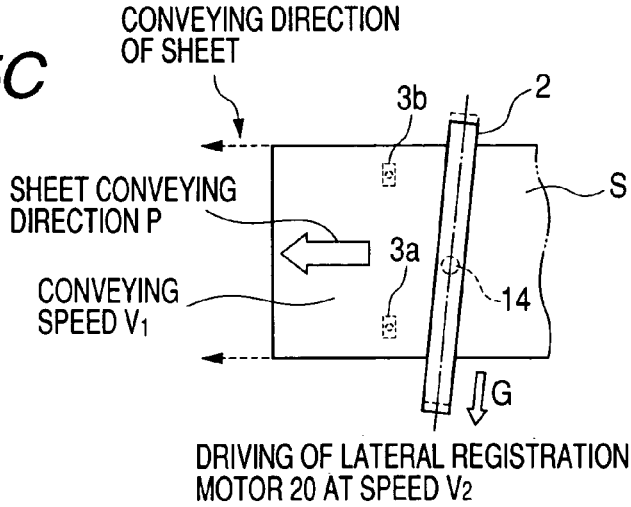
Figure 15D:
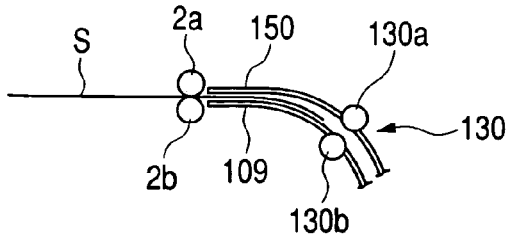

Next, the skew correction roller pair 2 is thus pivoted by the angle θ, and then a speed of the lateral moving motor 20 for skew feeding correction is determined based on Expression 2 above (step S10). Thereafter, the lateral moving motor 20 is driven (turned ON) (step S11), and the skew correction roller pair 2 is moved in a direction of the arrow G as shown in FIG. 15C. Then, by moving the skew correction roller pair 2 in the direction of the arrow G in this way, the skew feeding of the sheet S is corrected, and the conveying direction of the sheet S is returned to the original direction. Consequently, skew conveying/skew feeding correction for the sheet S can be performed.

Next, as shown in FIG. 15D, when the trailing edge of the sheet S has passed through the upstream roller pair 130 (Y in step S12), the guide release solenoid 30 is turned OFF (step S13) and the upper upstream roller 130*b* is pivoted downward together with the upper guide 150 to be returned to the original state. After that, the sheet is further conveyed. Then, after the trailing edge of the sheet S has passed through the skew correction roller pair 2 (Y in step S14), the lateral moving motor 20 is stopped (turned OFF) (step S15).

Since the correction operation described above is performed, the sheet S is not skewed with respect to the transfer portion 112*b* and delivered in an accurate conveying posture. Thereafter, a toner image is transferred onto the sheet S. Then, an initializing operation for the skew correction roller pair 2 is performed (step S16) to prepare for skew conveying/skew feeding correction for the next sheet S. Note that this initializing operation is performed on the basis of signals from the first home position sensor 21 and the second home position sensor 25 as described earlier.

As described above, skew of the sheet S is detected, the skew correction roller pair 2 is pivoted according to a skew amount of the sheet, which allows for skew conveying correction of the sheet S. In addition, the skew correction roller pair 2 is moved in the thrust direction by the lateral moving motor 20 while conveying the sheet S, which allows for skew feeding correction.

Moreover, as in this embodiment, while the skew correction roller pair 2 is pivoted (moved) in a direction for correcting skew of the sheet S, the upper guide 150 is pivoted upward and the sheet nipping state of the upstream roller pair 130 is released. Consequently, at the time of sheet rotation following the movement of the skew correction roller pair 2, a load can be prevented from being applied to the sheet trailing edge side, and skew conveying correction can be performed accurately. Further, these operations make it possible to perform extremely accurate skew conveying/skew feeding correction without temporarily stopping the sheet S.

Note that in this embodiment, the upper guide 150 and the upper upstream roller 130*b* are returned to the original states thereof at the point when the sheet trailing edge has passed through the upstream roller pair 130. However, the conveying direction of the skew correction roller pair 2 and the conveying direction of the upstream roller pair 130 are the same at a point when the thrust movement by the lateral moving motor 20 is started. Thus, the upper guide 150 and the upper upstream roller 130*b* may be returned to the original states at this point.

In addition, in this embodiment, the upper guide 150 and the upper upstream roller 130*b* are moved by one solenoid. However, solenoids may be provided in the upper guide 150 and the upstream upper roller 130*b* independently. In this case, pivot timing for the upper guide 150 and press-contact/separation timing for the upstream roller pair 130 can be set independently, which is advantageous for control of a small paper interval and the like. Moreover, if the sheet conveying apparatus is constituted so as to enable press-contact/separation control for the conveying roller 105 and the like arranged on the upstream side in the sheet conveying direction, the sheet conveying apparatus can cope with a long sheet S.

Further, in this embodiment, the upper guide 150 and the upper upstream roller pair 130*b* are integrally pivoted upward. However, a resistance at the time of sheet rotation in sheet skew conveying/skew feeding correction can be reduced, and skew conveying/skew feeding accuracy can be improved only by the upward pivoting of the upper guide 150 or the release of the sheet nipping state of the upstream roller pair 130.

Next, a third embodiment of the present invention will be explained.

Figure 16:
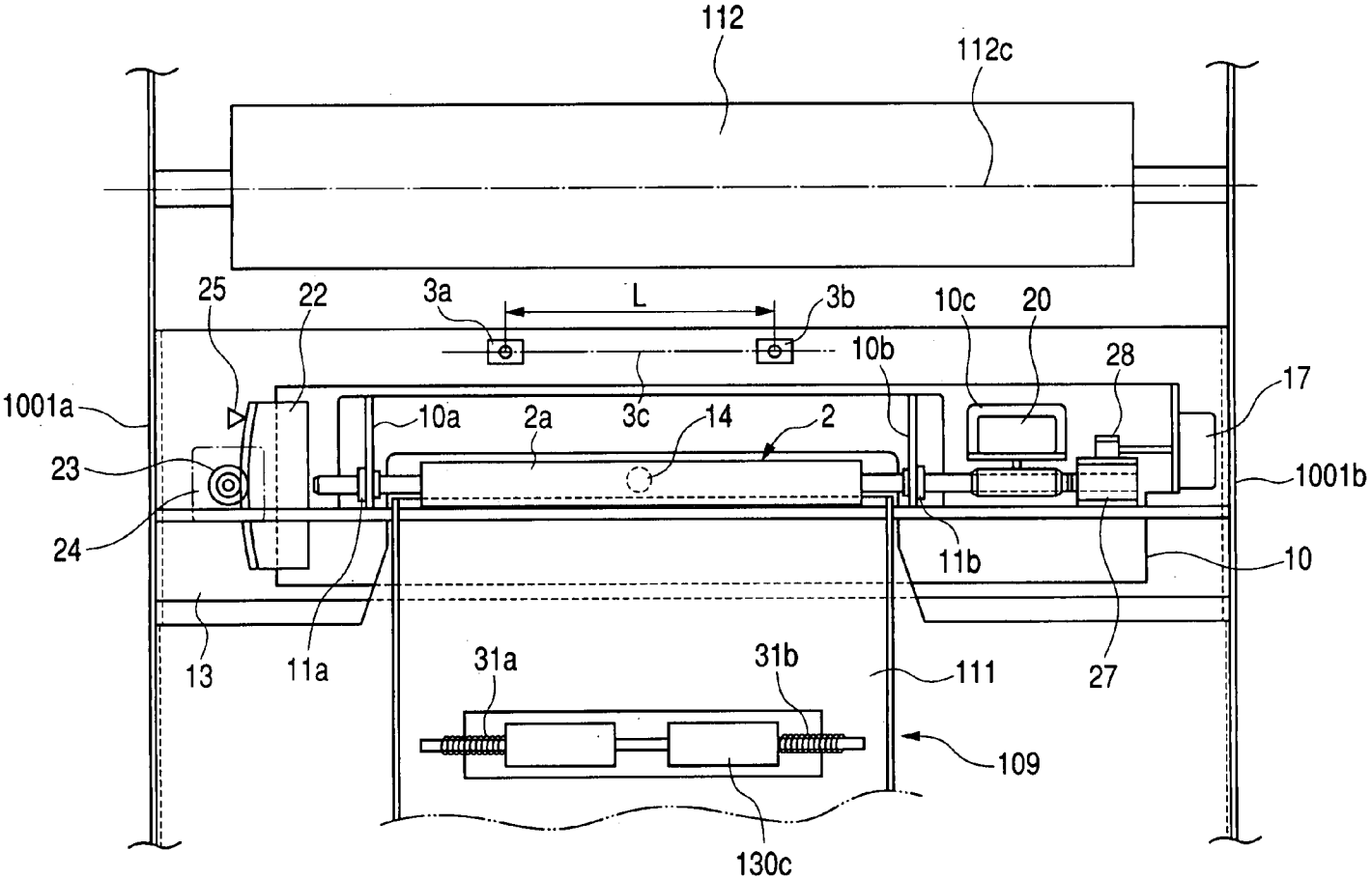
FIG. 16 is a plan view of a skew correction roller portion of a sheet conveying apparatus in accordance with a third embodiment of the present invention.

FIG. 16 is a plan view of a skew correction roller portion of a sheet conveying apparatus in accordance with this embodiment. Note that, in FIG. 16, reference numerals and symbols identical with those in FIG. 8 denote identical or equivalent portions.

In the figure, reference symbol 130*c* denotes an upper upstream roller constituting the upstream roller pair 130. At least the upper upstream roller 130*c* is supported rotatably and movably in a thrust direction to the upper guide 111. Note that the upper upstream roller 130*c* is usually held in a predetermined position shown in the figure by the action of biasing springs 31*a* and 31*b* that bias the upper upstream roller 30*c* inwardly, respectively.

In this way, at least the upper upstream roller 130*c* constituting the upstream roller pair 130 is constituted movably in the thrust direction. Therefore, when the sheet S rotates as described above at the time of skew conveying/skew feeding correction of the sheet S, the upper upstream roller 130*c* is capable of moving in the thrust direction in synchronization with the movement of the sheet S.

Consequently, a load at the time of rotation of the sheet S in skew conveying/skew feeding correction can be reduced. As a result, sheet rotation can be performed smoothly, and skew conveying/skew feeding correction accuracy can be improved. Note that, when a sheet trailing edge has passed through the upstream roller pair 130, the upper upstream roller 130*c* can return to the predetermined position shown in the figure by the action of the biasing springs 31*a* and 31*b*.

Next, a fourth embodiment of the present invention will be explained.

Figure 17:
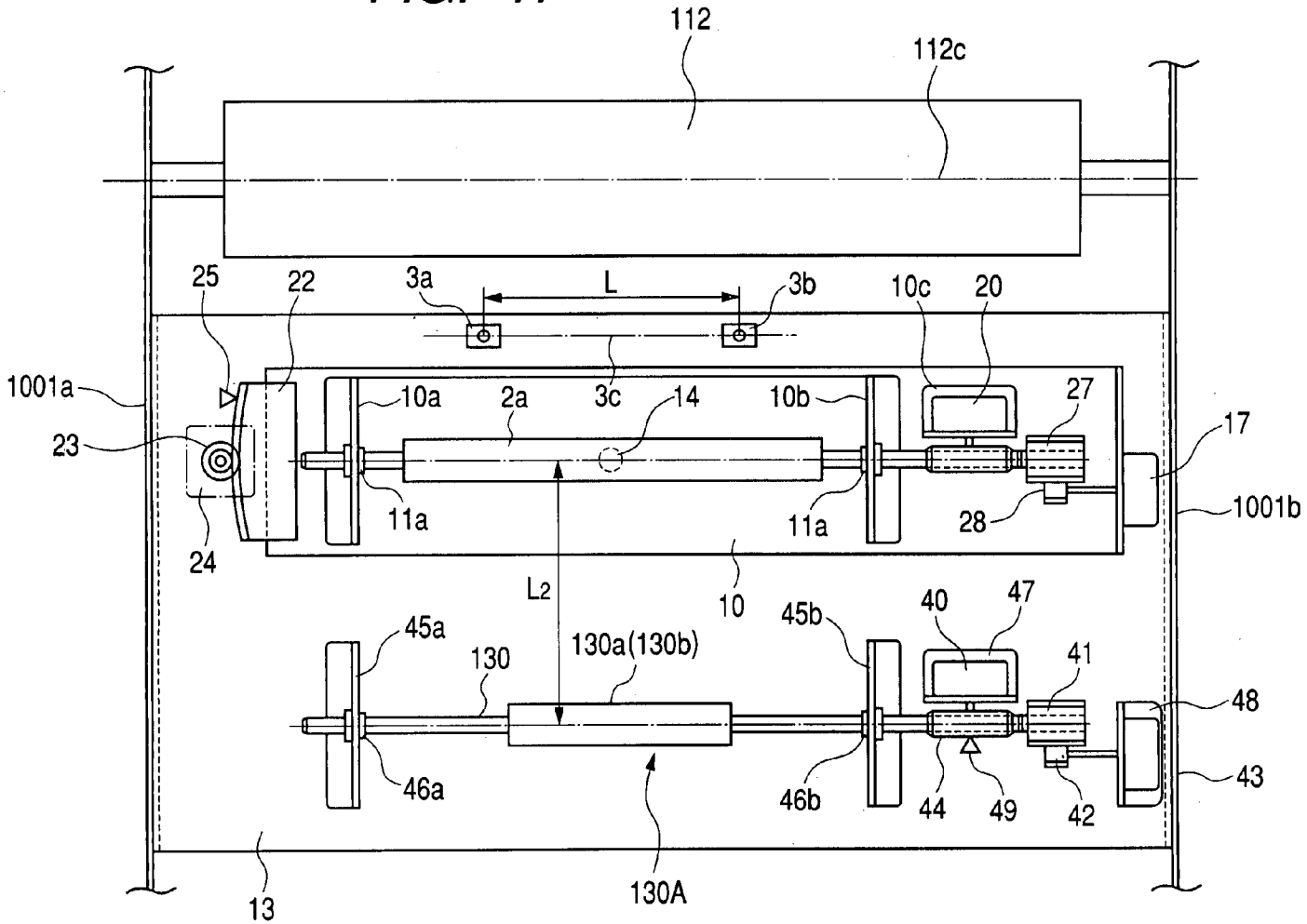
FIG. 17 is a plan view of a skew correction roller portion of a sheet conveying apparatus in accordance with a fourth embodiment of the present invention.

FIG. 17 is a plan view of a skew correction roller portion of a sheet conveying apparatus in accordance with this embodiment. Note that, in FIG. 17, reference numerals and symbols identical with those in FIG. 10 denote identical or equivalent portions.

In FIG. 17, reference symbol 130A denotes an upstream roller pair. The upstream roller pair 130A is rotatably supported to a front side plate 45*a* and a rear side plate 45*b*, which are provided on the stay 13, via bearings 46*a* and 46*b*.

Moreover, a drive input gear 41 is fixed to a shaft end of the upstream roller pair 130A, and a gear 42 fixed to an output shaft of an upstream motor 43 engages with the drive input gear 41. With this structure, when the upstream motor 43 is driven, the upstream roller pair 130A is accordingly rotated.

Provided on a side of the upstream motor of the upstream roller pair 130A is a coupling member 44, which couples the upstream rollers 130*a* and 130*b*. Then, the coupling member 44 supports the respective upstream rollers 130*a* and 130*b* rotatably, a rack gear portion (not shown) is provided on a bottom surface thereof, and a pinion gear (not shown) fixed to an output shaft of an upstream lateral moving motor 40 engages with the rack gear portion.

Consequently, when the upstream lateral moving motor 40 rotates, the upstream lateral roller pair 130A moves in the thrust direction. When the coupling member 44 thus moves in the above-mentioned direction, the upstream roller pair 130A is moved in the thrust direction according to this movement.

Also, in FIG. 17, reference numeral 49 denotes a third home position sensor. A home position in the thrust direction of the upstream roller pair 130A can be detected by the third home position sensor 49.

Figure 18:
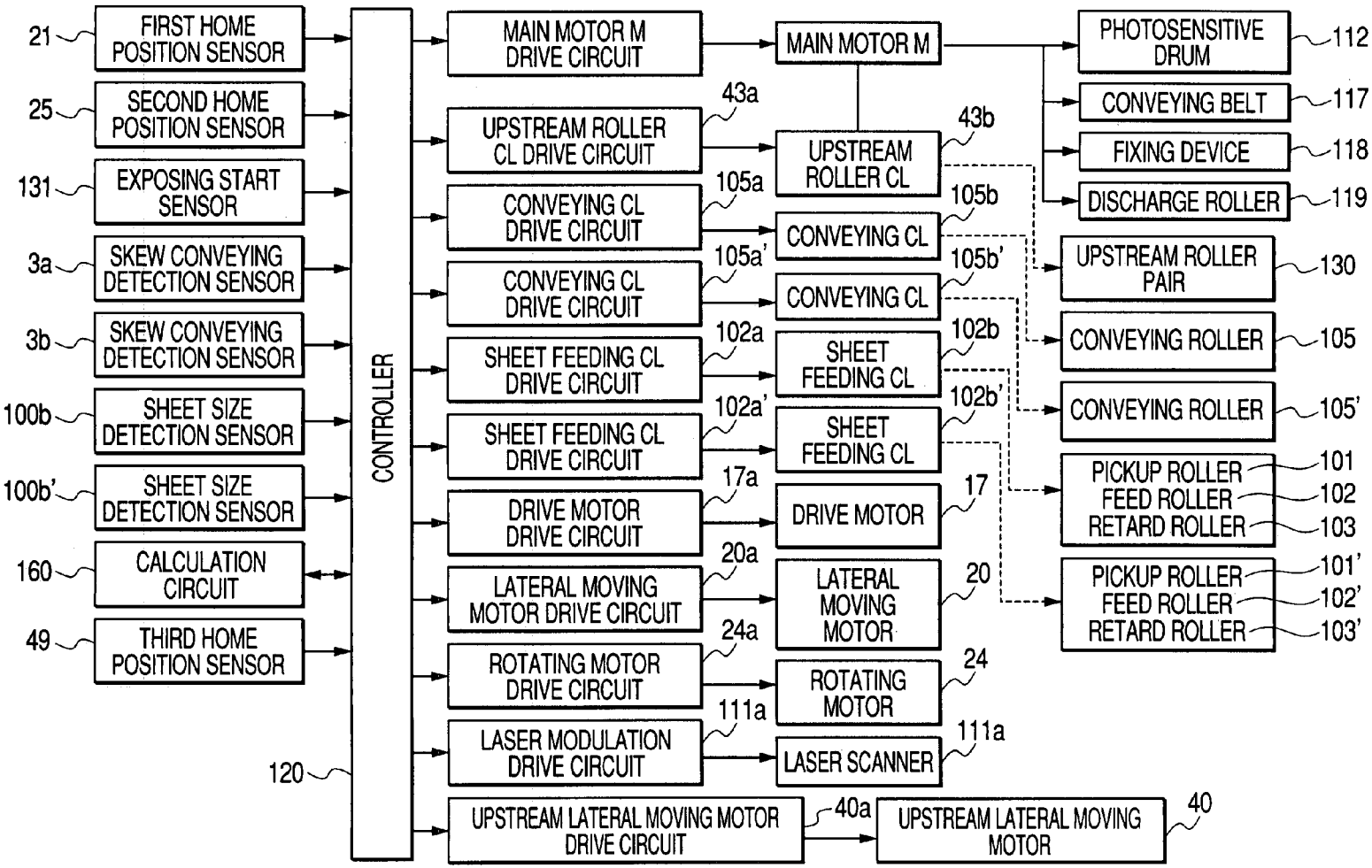
FIG. 18 is a control block diagram of a printer including the sheet conveying apparatus.
Figure 19:
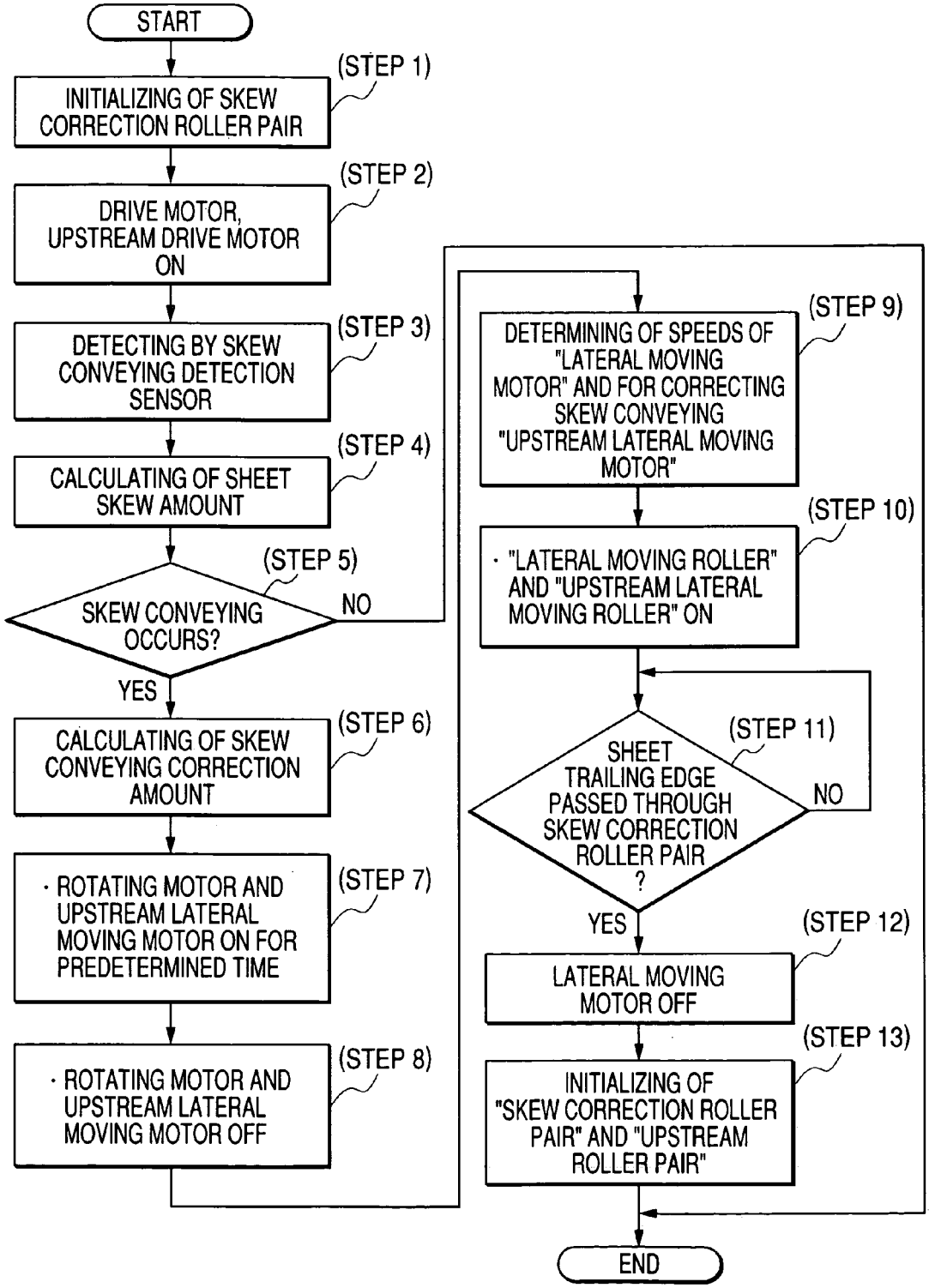
FIG. 19 is a flowchart explaining a skew conveying correction operation of the sheet conveying apparatus.

Note that FIG. 18 is a control block diagram of the printer 1000 including the sheet conveying apparatus 1004 and the like. As shown in the figure, the third home position sensor 49 is connected to the controller 120. In addition, in the controller 120, a skew amount of the sheet S is calculated by the calculation circuit 160 on the basis of detection signals from the skew conveying detection sensors 3*a* and 3*b*.

Moreover, in this embodiment, the controller 120 is connected to an upstream drive motor 43 and an upstream lateral moving motor 40 via drive circuits 43*a* and 40*a*, respectively, and is adapted to drive the upstream drive motor 43 and the upstream lateral moving motor 40 by predetermined amounts by outputting necessary control signals based upon a result of the calculation.

Next, a skew conveying correction operation of the printer 1000 (sheet conveying apparatus 1004) with such a structure will be explained with reference to a flowchart of FIG. 19 and FIGS. 20A, 20B, 21A and 21B.

First, when a start button (not shown) of the printer 1000 is pressed, the lateral moving motor 20, the rotating motor 24, and the upstream lateral moving motor 40 operate, to perform an initializing operation in a rotating direction and a thrust direction of the skew correction roller pair 2 and a thrust direction of the upstream roller 130A with the first home position sensor 21, the second home position sensor 25, and the third home position sensor 49 (step S1).

Figure 20A:
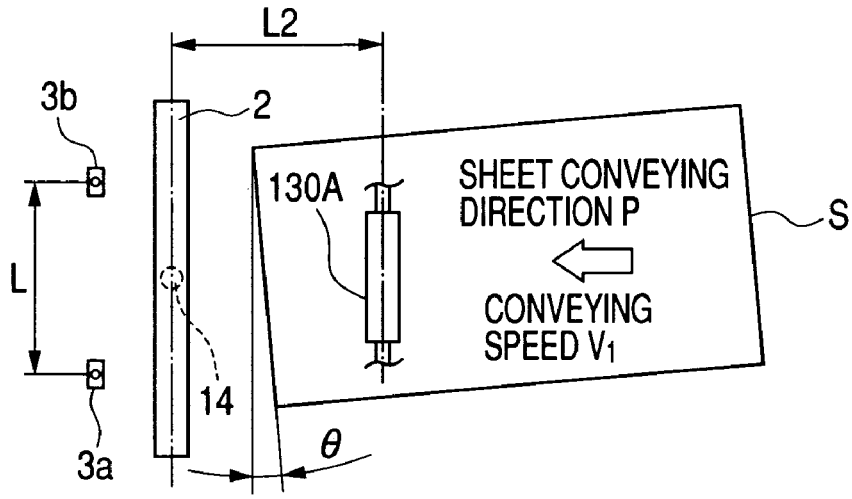
FIGS. 20A and 20B are first diagrams illustrating the skew conveying correction operation of the sheet conveying apparatus.
Figure 20B:
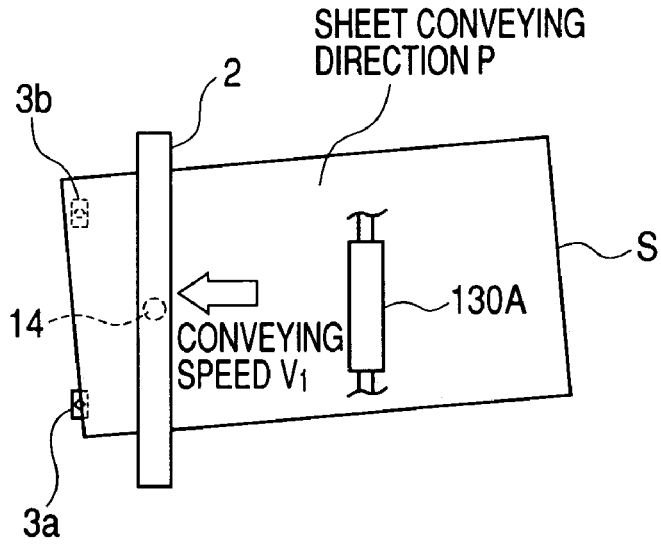

Then, after this initializing operation, the drive motor 17 and the upstream drive motor 43 are driven (turned ON), and the skew correction roller pair 2 and the upstream roller pair 130A start rotation (step S2). The sheet S, which is skew-conveyed by the angle θ with respect to the sheet conveying direction P as shown in FIG. 20A is fed to the upstream roller pair 130A that has started rotation in this way. Thereafter, the sheet S enters the nip portion of the skew correction roller pair 2 and is nipped by the skew correction roller pair 2 as shown in FIG. 20B.

Next, the sheet S nipped by the skew correction roller pair 2 is fed and moves forward along the sheet conveying direction P in the skewed state. A passing point in time of the leading edge of the sheet S is detected by the skew conveying detection sensors 3*a* and 3*b* that are arranged on the downstream side of the skew correction roller pair 2 (step S3).

Here, detection signals from the skew conveying detection sensors 3*a* and 3*b* are inputted to the controller 120. A skew amount of the sheet S nipped by the skew correction roller pair 2 is calculated from a difference between sheet detection time of the skew conveying detection sensor 3*a* and sheet detection time of the skew conveying detection sensor 3*b* (step S4).

Next, the controller 120 judges whether skew conveying of the sheet S has occurred from a result of this calculation (step S5). If skew conveying of the sheet S has not occurred (N in step S5), the controller 120 does not perform a correction operation. If skew conveying of the sheet S has occurred (Y in step S5), the controller 120 calculates a skew conveying correction amount for the skew conveying, that is, drive amounts of the rotating motor 24 and the upstream lateral moving motor 40 (step S6) based on Expression 1 above.

Figure 21A:
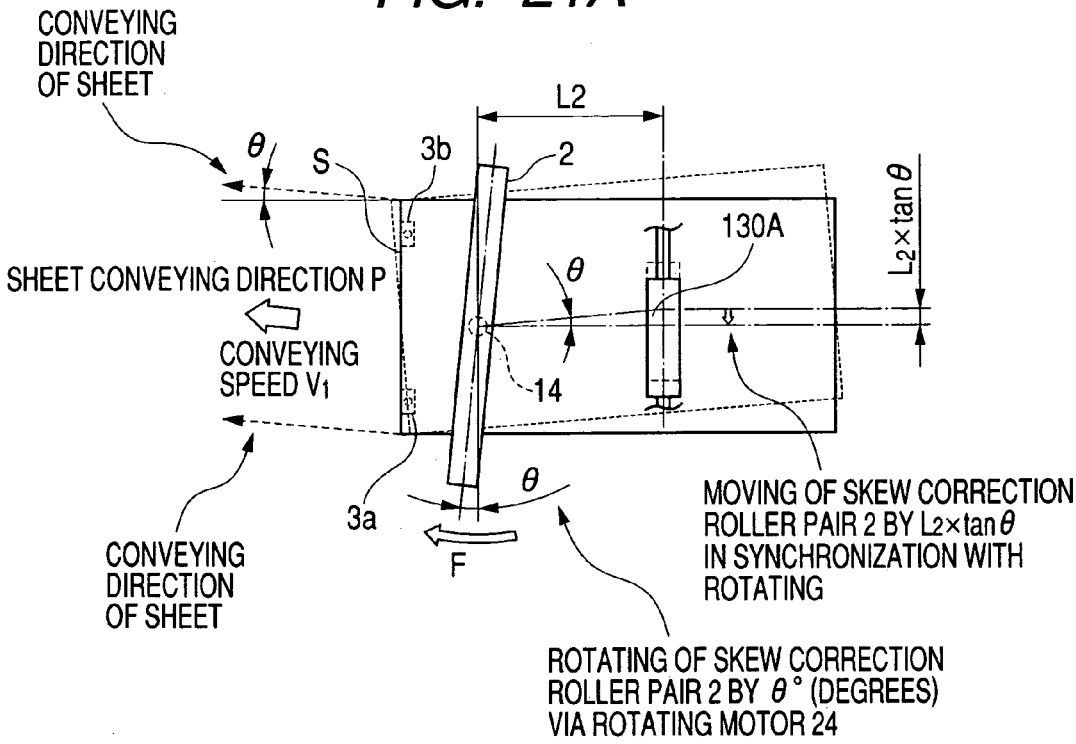
FIGS. 21A and 21B are second diagrams illustrating the skew conveying correction operation of the sheet conveying apparatus.
Figure 21B:
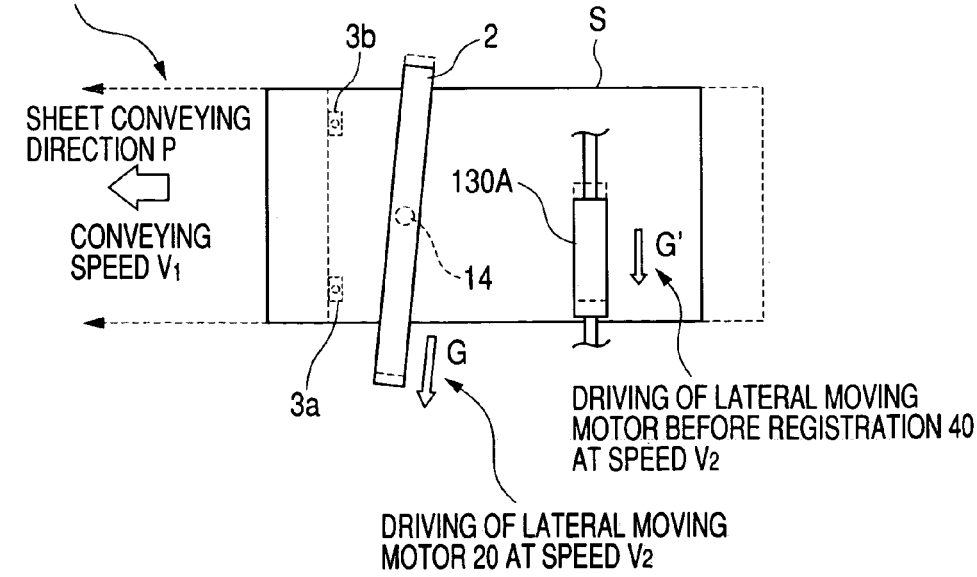

Note that, when a distance from the rotation center point 14 of the skew correction roller pair 2 to the upstream roller pair 130A is represented by L2, an amount of movement of the upstream roller pair 130A by the upstream lateral moving motor 40 can be calculated from Expression 3 below as is apparent from FIG. 21A.

$$L2 \times \mathrm{Tan}\ \theta \tag{3}$$

Thereafter, the rotating motor 24 is driven (turned ON) for a predetermined time according to the correction amount calculated from Expression 3 above, and the upstream lateral moving motor 40 is driven (turned ON) for a predetermined time according to the calculated correction amount (step S7).

Here, the rotating motor 24 is driven with respect to the skew of the sheet S, whereby the skew correction roller pair 2 pivots by the angle θ in a direction of the arrow F around the pivotal shaft 14 to bring the leading edge of the sheet S nipped by the skew correction roller pair 2 into a state of being parallel with the axial direction of the transfer portion 112*b* (axial direction of the photosensitive drum), and the upstream roller pair 130A moves by an amount calculated from L2×Tan θ. Then, the rotating operation of the sheet S can be performed very smoothly by such movement of the upstream roller pair 130A.

Note that, in the case in which the skew correction roller pair 2 pivots in this way, the conveying direction of the sheet S to be conveyed by the skew correction roller pair 2 is also inclined by the same angle (θ) compared with the original direction. As a result, the entire sheet is skew-fed in an oblique direction indicated by the dashed line at the inclined angle (θ).

Thus, in this embodiment, the skew correction roller pair 2 is rotated by the angle θ, and after stopping (turning OFF) the lateral moving motor 20 and the upstream lateral moving motor 40 (step S8), speeds of the lateral moving motor 20 and the upstream lateral moving motor 40 for skew feeding correction are determined based on Expression 2 above. Thereafter, the lateral moving motor 20 and the upstream lateral moving motor 40 are driven (turned ON) (step S10).

Consequently, the skew correction roller pair 2 and the upstream roller pair 130A move in directions of the arrows G and G' . Then, by moving the skew correction roller pair 2 and the upstream roller pair 130A in this way, the skew feeding of the sheet S is corrected, and the conveying direction of the sheet S is returned to the original direction. Consequently, skew conveying/skew feeding correction for the sheet S can be performed.

Next, when the trailing edge of the sheet S has passed through the upstream roller pair 130A, the upstream lateral moving motor 40 is stopped. When the trailing edge of the sheet S has passed through the skew correction roller pair 2 (Y in step S11), the lateral moving motor 20 is stopped (turned OFF) (step S12).

Since the correction operation described above is performed, the sheet S is not skewed with respect to the transfer portion 112*b* and delivered in an accurate conveying posture. Thereafter, a toner image is transferred onto the sheet S. Then, an initializing operation for the skew correction roller pair 2 and the upstream roller pair 130A is performed (step S13) to prepare for skew conveying/skew feeding correction for the next sheet S. Note that this initializing operation is performed on the basis of signals from the first home position sensor 21, the second home position sensor 25, and the third home position sensor 49 as described earlier.

As described above, skew of the sheet S is detected, the skew correction roller pair 2 is pivoted according to a skew amount of the sheet, and the upstream roller pair 130A is moved in the thrust direction in accordance with an amount of rotation of the sheet S. Consequently, the skew conveying correction for the sheet S can be performed.

Moreover, thereafter, while the sheet S is. conveyed, the skew correction roller pair 2 and the upstream roller pair 130A are moved in the thrust direction by the lateral moving motor 20 and the upstream lateral moving motor 40, respectively, whereby skew feeding correction can also be performed. These operations make it possible to perform extremely accurate skew conveying/skew feeding correction without temporarily stopping a sheet.

In addition, as described above, at the time of skew conveying/skew feeding correction, the upstream roller pair 130A also performs thrust movement control according to movement of the sheet S, whereby there is no resistance at the time of correction. Moreover, the upstream roller pair 130A assists rotation and thrust movement of a sheet, whereby skew conveying correction accuracy and skew feeding correction accuracy are improved remarkably.

In the above explanation, the sheet conveying means is used for the image forming apparatus such that the sheet S can be delivered to the image forming portion 1003 accurately without skew and positional deviation. However, the present invention is not limited to this and can be applied to an image reading apparatus such that the sheet S can be delivered to an image reading portion, which reads a sheet (original) in a post-process, accurately without skew and positional deviation.

What is claimed is:

1. A sheet conveying apparatus for conveying a sheet using sheet conveying means arranged along a sheet conveying path, comprising:

skew detecting means for detecting skew of the sheet conveyed along the sheet conveying path with respect to a sheet conveying direction;

skew correcting means that moves in a direction for correcting the skew of the skewed sheet with the sheet nipped therein on the basis of a detection signal from the skew detecting means; and guide means supported by said skew correcting means for guiding the sheet to the skew correcting means, wherein, when the skew correcting means moves for correcting the skew of the sheet, the guide means is moved together with the skew correcting means so as to prevent a load from being applied to a trailing edge side of the sheet.

2. A sheet conveying apparatus according to claim 1, wherein the guide means is integrally provided in the skew correcting means.

3. A sheet conveying apparatus for conveying a sheet, comprising:

a skew conveying detection sensor that is arranged on a sheet conveying path;

a skew correction roller pair that rotates in a direction for correcting skew of a skewed sheet with the sheet nipped therein on the basis of a detection signal from the skew conveying detection sensor; and a guide that guides the sheet to said skew correction roller pair wherein said guide is arranged on an upstream side of said skew correction roller pair.

wherein said guide is integral with said skew correction roller pair, when said skew correction roller pair corrects skew of the skewed sheet, said guide rotates together with said skew correction roller pair so as to prevent a load from being applied to a trailing edge side of the sheet.

4. An image forming apparatus, comprising:

an image forming portion that forms an image on a sheet; and a sheet conveying apparatus according to any one of claims 1, 2 and 3 that conveys the sheet to the image forming portion.

* * * * *

UNITED STATES PATENT AND TRADEMARK OFFICE

CERTIFICATE OF CORRECTION

PATENT NO. : 7,195,238 B2
APPLICATION NO. : 10/889118
DATED : March 27, 2007
INVENTOR(S) : Takeshi Suga et al.

It is certified that error appears in the above-identified patent and that said Letters Patent is hereby corrected as shown below:

COLUMN 3:
Line 26, “a.” should read --a--.

COLUMN 4:
Line 49, “like. Here” should read --like. ¶ Here--.

COLUMN 5:
Line 39, “the.” should read --the--.

COLUMN 11:
Line 22, “form” should read --from--.

COLUMN 15:
Line 52, “is.” should read --is--.

COLUMN 16:
Line 49, “pair,” should read --pair, so that--.

Signed and Sealed this

Fourth Day of December, 2007

JON W. DUDAS
*Director of the United States Patent and Trademark Office*